US010410595B2

(12) United States Patent
Ishii

(10) Patent No.: US 10,410,595 B2
(45) Date of Patent: Sep. 10, 2019

(54) DISPLAY DRIVER

(71) Applicant: LAPIS Semiconductor Co., Ltd., Yokohama (JP)

(72) Inventor: Hiroaki Ishii, Yokohama (JP)

(73) Assignee: LAPIS Semiconductor Co., Ltd., Yokohama (JP)

( * ) Notice: Subject to any disclaimer, the term of this patent is extended or adjusted under 35 U.S.C. 154(b) by 264 days.

(21) Appl. No.: 14/609,916

(22) Filed: Jan. 30, 2015

(65) Prior Publication Data

US 2015/0221274 A1 Aug. 6, 2015

(30) Foreign Application Priority Data

Jan. 31, 2014 (JP) ..... 2014-017236

(51) Int. Cl.
*G09G 3/3275* (2016.01)
*G09G 3/36* (2006.01)

(52) U.S. Cl.
CPC ..... *G09G 3/3677* (2013.01); *G09G 3/3685* (2013.01); *G09G 3/3275* (2013.01); *G09G 2310/0272* (2013.01); *G09G 2310/0286* (2013.01); *G09G 2310/08* (2013.01); *G09G 2320/0233* (2013.01); *G09G 2352/00* (2013.01)

(58) Field of Classification Search
CPC .. G09G 3/3677; G09G 3/3685; G09G 3/3688; G09G 3/3696; G09G 3/3275; G09G 3/3283; G09G 3/3291; G09G 2310/0272; G09G 2310/08; G09G 2310/0243; G09G 2310/0264; G09G 2310/027; G09G 2310/0275; G09G 2310/0283; G09G 2310/0286; G09G 2310/0278; G11C 19/28; G11C 19/00
See application file for complete search history.

(56) References Cited

U.S. PATENT DOCUMENTS 5,874,934 A * 2/1999 Ito ..... G09G 3/3648 345/100
5,894,296 A * 4/1999 Maekawa ..... G09G 3/3688 345/100

(Continued)

FOREIGN PATENT DOCUMENTS

CN 102693693 A 9/2012
JP S62-245289 A 10/1987

(Continued)

*Primary Examiner* — Nitin Patel
*Assistant Examiner* — Amen Woldesenbet Bogale
(74) *Attorney, Agent, or Firm* — Rabin & Berdo, P.C.

(57) ABSTRACT

First to N-th latches capture N pieces of pixel data indicative of the luminance levels of respective pixels in synchronization with first to N-th capture clock signals each having different edge timing. Voltages corresponding to the pieces of pixel data output from the first to N-th latches are applied to each of the data lines of the display device. In this case, first to N-th flip-flops formed in an N-stage shift register capture a single pulse load signal which is synchronized with a horizontal synchronizing signal in a video signal while sequentially shifting the load signal to subsequent stages in synchronization with a reference timing signal supplied from the outside. Outputs of the first to N-th flip-flops in the N-stage shift register are supplied as first to N-th capture clock signals, to the first to N-th latches, respectively.

13 Claims, 17 Drawing Sheets

(56) References Cited

U.S. PATENT DOCUMENTS 6,542,139 B1 * 4/2003 Kanno ..... G09G 3/3677 345/87
6,724,361 B1 * 4/2004 Washio ..... G09G 3/3677 345/100
6,876,365 B1 * 4/2005 Tsutsui ..... G09G 3/20 345/100
2003/0173991 A1 * 9/2003 Takafuji ..... G01R 31/318533 324/750.3
2003/0179174 A1 * 9/2003 Matsuda ..... G09G 3/3677 345/100
2003/0184512 A1 * 10/2003 Hayashi ..... G09G 3/20 345/100
2003/0234761 A1 * 12/2003 Washio ..... G09G 3/3688 345/100
2004/0108989 A1 * 6/2004 Gyouten ..... G09G 3/3677 345/100
2004/0239659 A1 * 12/2004 Toriumi ..... G09G 3/3688 345/204
2005/0017065 A1 * 1/2005 Onda ..... G06F 5/01 235/375
2005/0162372 A1 * 7/2005 Hashimoto ..... G09G 3/3648 345/99
2007/0222737 A1 * 9/2007 Kimura ..... G09G 3/3266 345/100
2008/0129675 A1 * 6/2008 Tanaka ..... G09G 3/3688 345/99
2008/0198126 A1 * 8/2008 Yamashita ..... G09G 3/3677 345/99
2009/0109161 A1 * 4/2009 Yamamoto ..... G11C 19/00 345/100
2012/0242722 A1 * 9/2012 Ishii ..... G09G 3/3685 345/691
2014/0267199 A1 * 9/2014 Sugimoto ..... G09G 3/3266 345/204

FOREIGN PATENT DOCUMENTS

JP H2-203388 A 8/1990
JP H8-286643 A 11/1996
JP 2004-301946 A 10/2004
JP 2007-171597 A 7/2007

* cited by examiner

DISPLAY DRIVER

BACKGROUND OF THE INVENTION

1. Field of the Invention

The present invention relates to a display driver that drives a display device in response to a video signal.

2. Background Art

In display devices such as liquid crystal display panels, a plurality of gate lines extending in a horizontal direction on a two-dimensional screen and a plurality of source lines extending in a vertical direction on the two-dimensional screen are arranged so as to intersect with each other. The display panels further incorporate a source driver and a gate driver. The source driver applies gradation display voltages to the respective source lines, the gradation display voltages corresponding to the luminance levels of respective pixels represented by an input video signal. The gate driver applies a scanning signal to the gate lines. As such a source driver, there is proposed a device configured to individually capture a plurality of pieces of display data for one horizontal synchronization period into each of a plurality of latches and to apply gradation display voltages to the respective source lines, the gradation display voltages corresponding to the display data captured into the respective latches (see, for example, Japanese Patent Application Laid-Open No. 2004-301946). In this source driver, the above-stated latches each capture the display data at the timing shifted by a delay circuit which uses a delay of inverter elements. With this configuration, the source driver avoids the situation of steep and simultaneous change in currents that flow into the respective source lines and thereby prevents noise generated in such a situation.

However, in the delay circuit as described in the foregoing, the delay amount is fixed in advance, and the delay amount itself is changed by manufacturing variations, environmental temperature, and the like. This makes it difficult for the driver to adapt to the specifications of various display devices.

SUMMARY OF THE INVENTION

Accordingly, an object of the present invention is to provide a display driver adaptable to the specifications of various kinds of display devices while suppressing generation of the above-stated noise.

The display driver according to the present invention is a display driver for applying pixel drive voltages to respective N data lines (N is a natural number of 2 or more) of a display device, the pixel drive voltages corresponding to luminance levels of respective pixels represented by a video signal, the display driver including: first to N-th latches is configured to capture and output N pieces of pixel data indicative of the luminance levels of the respective pixels in synchronization with first to N-th capture clock signals each having different edge timing; and an N stage shift register is configured to capture a load signal synchronized with a horizontal synchronizing signal in the video signal while sequentially shifting the load signal to a subsequent stage in synchronization with a reference timing signal supplied from an outside, wherein the N stage shift register includes first to N-th flip-flops connected in series to supply outputs of the first to N-th flip-flops to the first to N-th latches as the first to N-th capture clock signals, respectively.

According to the present invention, it becomes possible to provide a display driver with high versatility which is resistant to the influence of manufacturing variations, environmental temperature, and the like, and which is adaptable to the specifications of various kinds of display devices.

DETAILED DESCRIPTION OF THE INVENTION

Hereinbelow, embodiments of the present invention will be described in detail with reference to the accompanying drawings.

Figure 1:
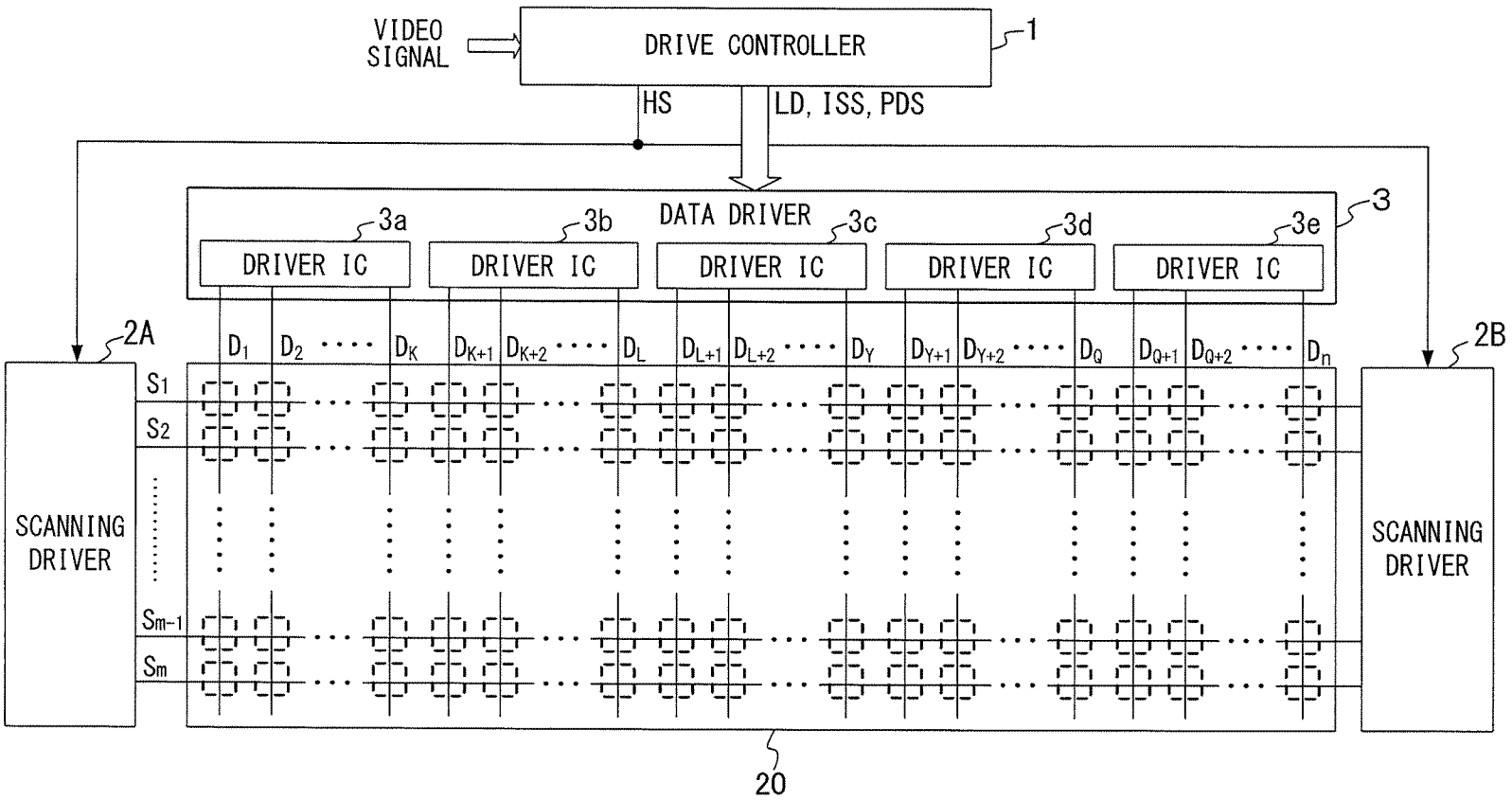
FIG. 1 is a block diagram illustrating a display apparatus including a display driver according to the present invention.

FIG. 1 is a schematic configuration view of a display apparatus including a display driver according to the present invention. As illustrated in FIG. 1, this display apparatus includes a drive controller 1, scanning drivers 2A and 2B, a data driver 3, and a display device 20.

For example, the display device 20 is made of a liquid crystal or organic EL panel. The display device 20 has m (m is a natural number of 2 or more) horizontal scan lines $S_1$ to $S_m$ each formed to extend in a horizontal direction on a two-dimensional screen and n (n is a natural number of 2 or more) data lines $D_1$ to $D_n$ each formed to extend in a vertical direction on the two-dimensional screen. A display cell that assumes a pixel is formed in each of crossing parts between the horizontal scan lines and the data lines.

The drive controller 1 extracts a horizontal synchronizing signal from a video signal, and supplies the horizontal synchronizing signal as a horizontal synchronizing signal HS to the scanning driver 2A and 2B. In synchronization with the horizontal synchronizing signal, the drive controller 1 generates a load signal LD indicative of the timing to start capturing of pixel data, and supplies the load signal LD to the data driver 3. Based on the video signal, the drive controller 1 also generates a sequence of pixel data PD that represents the luminance level of each pixel in eight bits for example, and superimposes a reference timing signal RS indicative of the timing of a clock signal on the sequence of pixel data PD to generate a pixel data signal PDS. The pixel data signal PDS is supplied to the data driver 3. The drive controller 1 further supplies to the data driver 3 an initial setting signal ISS for initial setting of each driver IC (described later) formed in the data driver 3. The initial setting signal ISS represents, for example, load delay time information LI and delay mode information DM. The load delay time information LI specifies the information corresponding to load delay time that is a period of time from supply point of the above-stated load signal LD to actual start point of loading the pixel data. The delay mode information DM specifies a delay mode (described later).

The scanning driver 2A is connected to one end of each of the horizontal scan lines $S_1$ to $S_m$. The scanning driver 2B is connected to the other end of each of the horizontal scan lines $S_1$ to $S_m$. The scanning drivers 2A and 2B respectively generate horizontal scanning pulses SP in synchronization with the above-stated horizontal synchronizing signal HS, and apply the horizontal scanning pulses SP to each of the horizontal scan lines $S_1$ to $S_m$ of the display device 20 in sequence.

The data driver 3 captures the sequence of pixel data PD in the pixel data signal PDS in response to the load signal LD in accordance with the operation mode (described later) set on the basis of the above-stated initial setting signal ISS. Whenever the pixel data PD for one horizontal scan line, i.e., n (n is the total number of data lines) pieces of pixel data PD, are captured, the data driver 3 converts the captured n pieces of pixel data PD into pixel drive voltages having voltage values corresponding to the luminance levels represented by the respective pieces of PD, and applies the pixel drive voltages to the data lines $D_1$ to $D_n$ of the display device 20.

The data driver 3 is formed from a plurality of semiconductor integrated circuit (IC) chips each having the same circuitry. For example, in an embodiment illustrated in FIG. 1, the data driver 3 is formed from five driver ICs 3*a* to 3*e*. In this case, out of n pieces of pixel data PD for one horizontal scan line, the driver IC 3*a* captures K (K is a natural number of 2 or more) pieces of pixel data PD corresponding to first to K-th columns of the display device 20. The driver IC 3*a* then applies pixel drive voltages $G_1$ to $G_K$ corresponding to the luminance levels represented by the respective pieces of the pixel data PD to the data lines $D_1$ to $D_K$ of the display device 20. Out of n pieces of pixel data PD for one horizontal scan line, the driver IC 3*b* captures K pieces of pixel data PD corresponding to (K+1)-th column to L-th column (L=2×K) of the display device 20. The driver IC 3*b* then applies pixel drive voltages $G_{K+1}$ to $G_L$ corresponding to the luminance levels represented by the respective pieces of pixel data PD to the data lines $D_{K+1}$ to $D_L$ of the display device 20. Out of n pieces of pixel data PD for one horizontal scan line, the driver IC 3*c* captures K pieces of pixel data PD corresponding to (L+1)-th column to Y-th column (Y=3×K) of the display device 20. The driver IC 3*c* then applies pixel drive voltages $G_{L+1}$ to $G_Y$ corresponding to the luminance levels represented by the respective pieces of pixel data PD to the data lines $D_{L+1}$ to $D_Y$ of the display device 20. Out of n pieces of pixel data PD for one horizontal scan line, the driver IC 3*d* captures K pieces of pixel data PD corresponding to (Y+1)-th column to Q-th column (Q=4×K) of the display device 20. The driver IC 3*d* then applies pixel drive voltages $G_{Y+1}$ to $G_Q$ corresponding to the luminance levels represented by the respective pieces of pixel data PD to the data lines $D_{Y+1}$ to $D_Q$ of the display device 20. Out of n pieces of pixel data PD for one horizontal scan line, the driver IC 3*e* captures K pieces of pixel data PD corresponding to (Q+1)-th column to n-th column of the display device 20. The driver IC 3*e* then applies pixel drive voltages $G_{Q+1}$ to $G_n$ corresponding to the luminance levels represented by the respective pieces of pixel data PD to the data lines $D_{Q+1}$ to $D_n$ of the display device 20.

More specifically, the driver ICs 3*a* and 3*b* for driving a screen left area of the display device 20, the driver IC 3*c* for driving a screen center area, and the driver ICs 3*d* and 3*e* for driving a screen right area are placed along one side of the display device 20 as illustrated in FIG. 1.

Since the circuit formed in each of the driver ICs 3*a* to 3*e* is identical, the configuration formed in each driver IC will be described by using the driver IC 3*a*.

Figure 2:
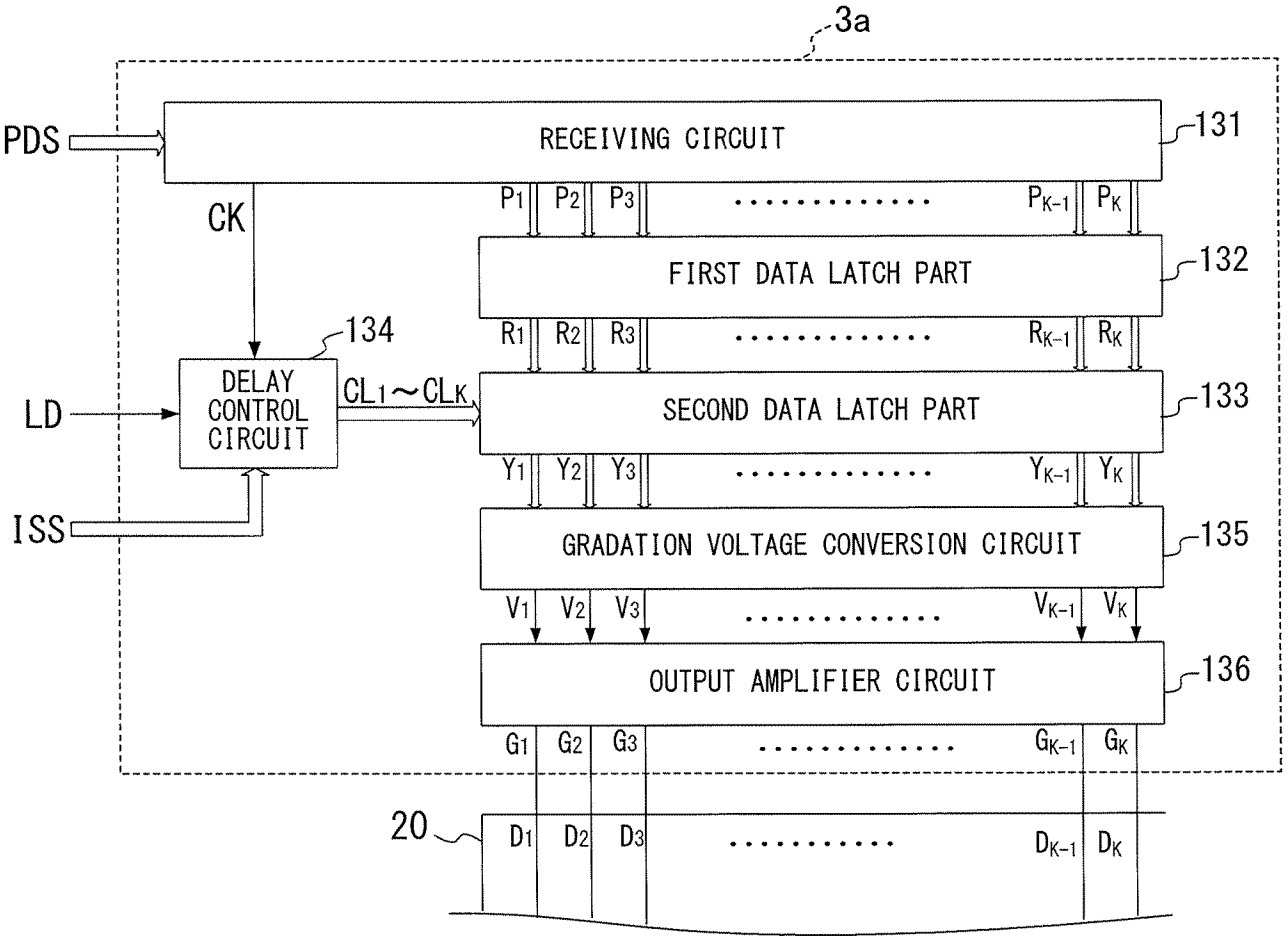
FIG. 2 is a block diagram illustrating an example of the internal configuration of a driver IC 3*a;*

FIG. 2 is a block diagram illustrating the circuit formed in the driver IC 3*a*. As illustrated in FIG. 2, each of the driver ICs includes a receiving circuit 131, a first data latch part 132, a second data latch part 133, a delay control circuit 134, a gradation voltage conversion circuit 135, and an output amplifier circuit 136.

The receiving circuit 131 captures a sequence of pixel data PD from a pixel data signal PDS supplied from the drive controller 1, and supplies the pixel data PD for one horizontal scan line (n pieces) to the first data latch part 132 as pixel data $P_1$ to $P_K$. The receiving circuit 131 extracts a reference timing signal RS from the pixel data signal PDS, and reproduces a reference clock signal CK that is phase-locked to the reference timing signal RS. The receiving circuit 131 then supplies the reference clock signal CK to the delay control circuit 134.

The first data latch part 132 captures each of the pixel data $P_1$ to $P_K$ supplied from the receiving circuit 131 in order of being supplied, and supplies the captured data as pixel data $R_1$ to $R_K$ to the subsequent second data latch part 133.

The delay control circuit 134 performs initial setting in accordance with an initial setting signal ISS supplied from the drive controller 1. In an operation mode based on the initial setting, the delay control circuit 134 generates delay capture clock signals $CL_1$ to $CL_K$ each having different edge timing and synchronized with the reference clock signal CK, in response to the above-stated load signal LD, and supplies the delay capture clock signals $CL_1$ to $CL_K$ to the second data latch part 133.

Figure 3:
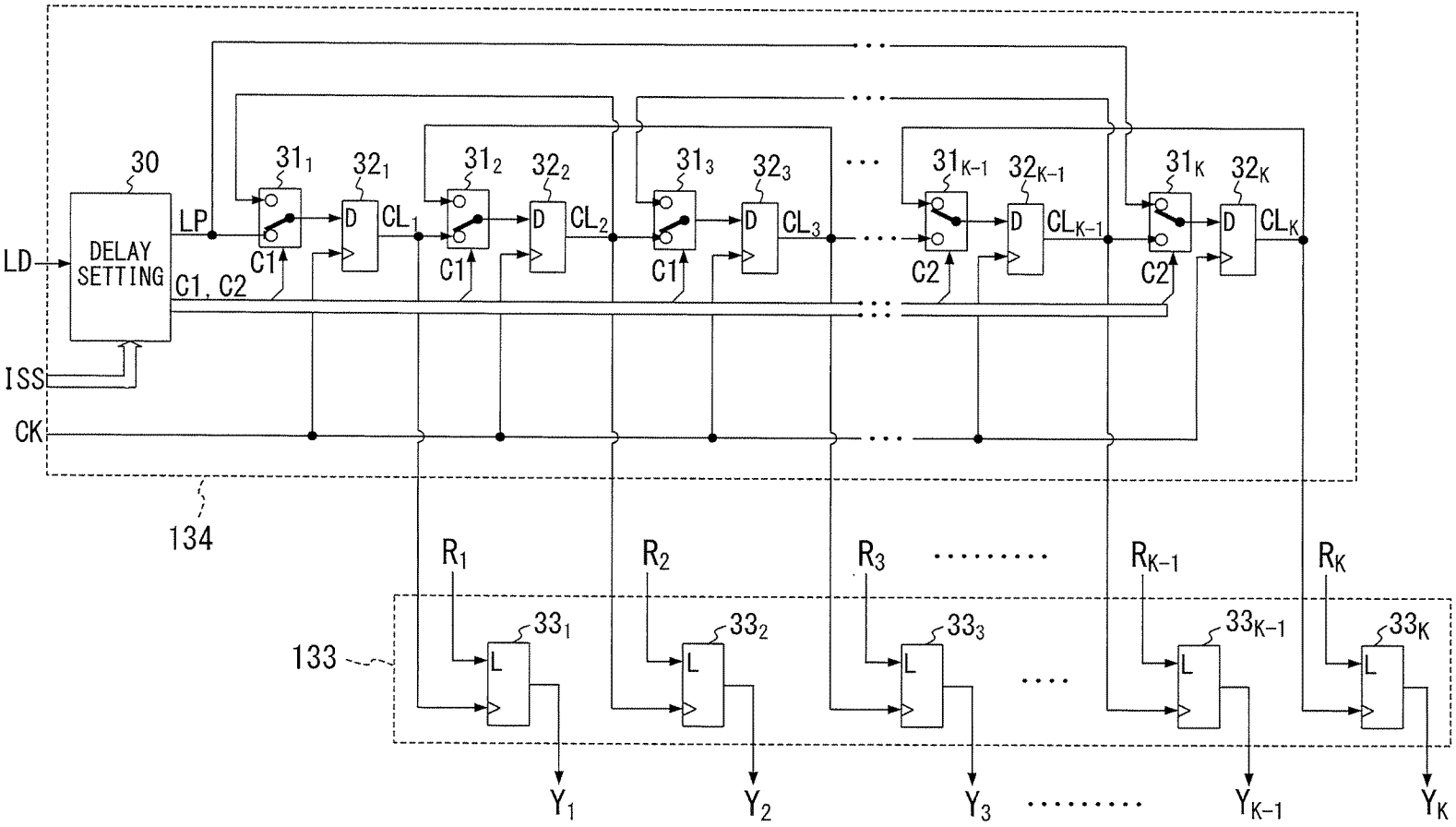
FIG. 3 is a circuit diagram illustrating an example of the internal configuration of a delay control circuit 134 and a second data latch part 132.

FIG. 3 is a circuit diagram illustrating an example of the internal configuration of each of the second data latch part 133 and delay control circuit 134. The delay control circuit 134 includes a delay setting part 30, K shift direction switches $\mathbf{31}_1$ to $\mathbf{31}_K$, and K D-flip-flops (hereinafter referred to as DFFs) $\mathbf{32}_1$ to $\mathbf{32}_K$.

In FIG. 3, the delay setting part 30 first stores the load delay time information LI and the delay mode information DM represented by the initial setting signal ISS supplied from the drive controller 1 in a built-in register (not illustrated). When the delay mode specified by the delay mode information DM is L shift mode (first shift mode), the delay setting part 30 supplies a switching signal C1 with a logic level 0 to the shift direction switches $\mathbf{31}_1$ to $\mathbf{31}_{(K/2)}$, while supplying a switching signal C2 with a logic level 0 to the shift direction switches $\mathbf{31}_{(1+K/2)}$ to $\mathbf{31}_K$. When the delay mode specified by the delay mode information DM is R shift mode (second shift mode), the delay setting part 30 supplies a switching signal C1 with a logic level 1 to the shift direction switches $\mathbf{31}_1$ to $\mathbf{31}_{(K/2)}$, while supplying a switching signal C2 with a logic level 1 to the shift direction switches $\mathbf{31}_{(1+K/2)}$ to $\mathbf{31}_K$. When the delay mode specified by the delay mode information DM is V shift mode (third shift mode), the delay setting part 30 supplies a switching signal C1 with a logic level 0 to the shift direction switches $\mathbf{31}_1$ to $\mathbf{31}_{(K/2)}$, while supplying a switching signal C2 with a logic level 1 to the shift direction switches $\mathbf{31}_{(1+K/2)}$ to $\mathbf{31}_K$.

Furthermore, when the load signal LD is supplied from the drive controller 1, the delay setting part 30 generates a load signal LP of a single pulse (but not a pulse train) at the time when load delay time represented by the load delay time information LI is passed after reception of the load signal LD. The delay setting part 30 then supplies the generated load signal LP to the shift direction switches $\mathbf{31}_1$ and $\mathbf{31}_K$.

The DFFs $\mathbf{32}_1$ to $\mathbf{32}_K$ each have a clock input terminal to which a reference clock signal CK is commonly supplied. As illustrated in FIG. 3, the DFFs $\mathbf{32}_1$ to $\mathbf{32}_K$ are also connected in series via the shift direction switch 31 provided prior to each of the DFFs. That is, the shift direction switches $\mathbf{31}_1$ to $\mathbf{31}_K$ and the DFFs $\mathbf{32}_1$ to $\mathbf{32}_K$ operate as a shift register which sequentially shifts the load signal LP to the subsequent DFFs 32 in response to the reference clock signal CK. Outputs of the respective DFFs $\mathbf{32}_1$ to $\mathbf{32}_K$ are supplied to the second data latch part 133 as delay capture clock signals $CL_1$ to $CL_K$. Here, a shift direction switch $\mathbf{31}_W$ (W is a natural number of 2 to [K−1]) selects one of a delay capture clock signal $CL_{W-1}$ output from the DFF $\mathbf{32}_{W-1}$ and a delay capture clock signal $CL_{W+1}$ output from the DFF $\mathbf{32}_{W+1}$ in accordance with the switching signal C1 or C2, and supplies the selected signal to the DFF $\mathbf{32}_W$. The shift direction switch $\mathbf{31}_1$ selects one of the load signal LP and the delay capture clock signal $CL_2$ output from the DFF $\mathbf{32}_2$ in accordance with the switching signal C1, and supplies the selected signal to the DFF $\mathbf{32}_1$. The shift direction switch $\mathbf{31}_K$ selects one of the load signal LP and the delay capture clock signal $CL_{K-1}$ output from the DFF $\mathbf{32}_{K-1}$ in accordance with the switching signal C2, and supplies the selected signal to the DFF $\mathbf{32}_K$.

Figure 4:
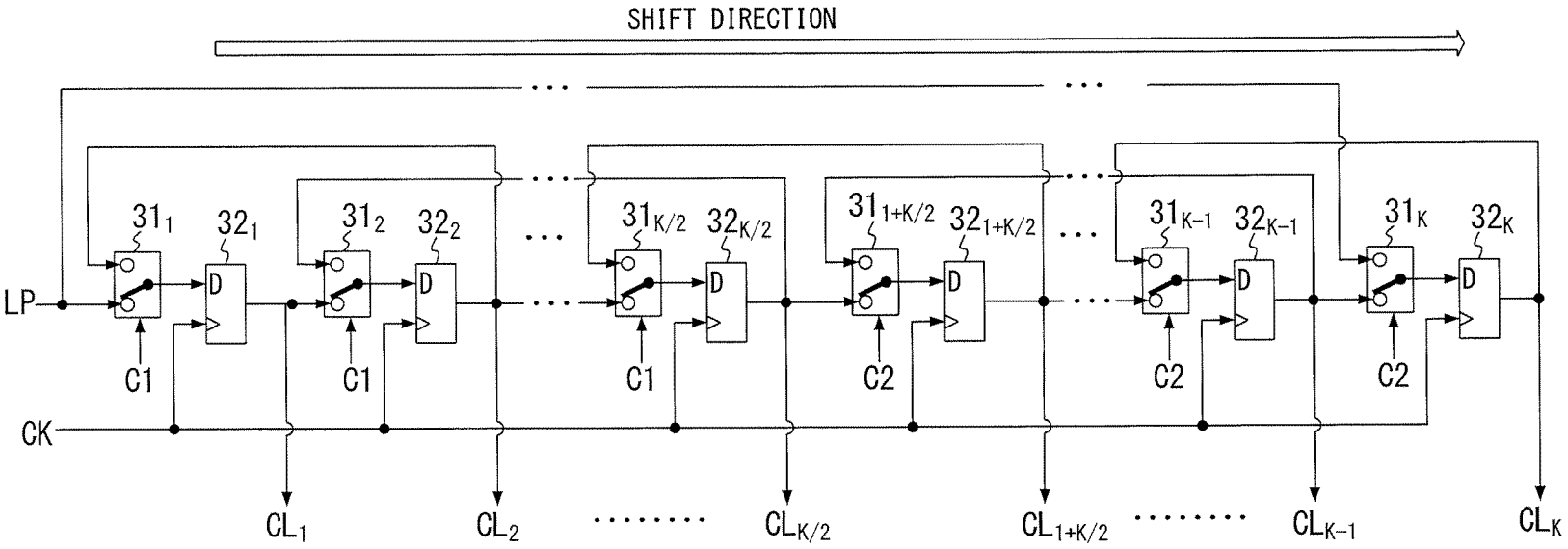
FIG. 4 illustrates switch states of shift direction switches $\mathbf{31}_1$ to $\mathbf{31}_K$ in L shift mode.
Figure 5:
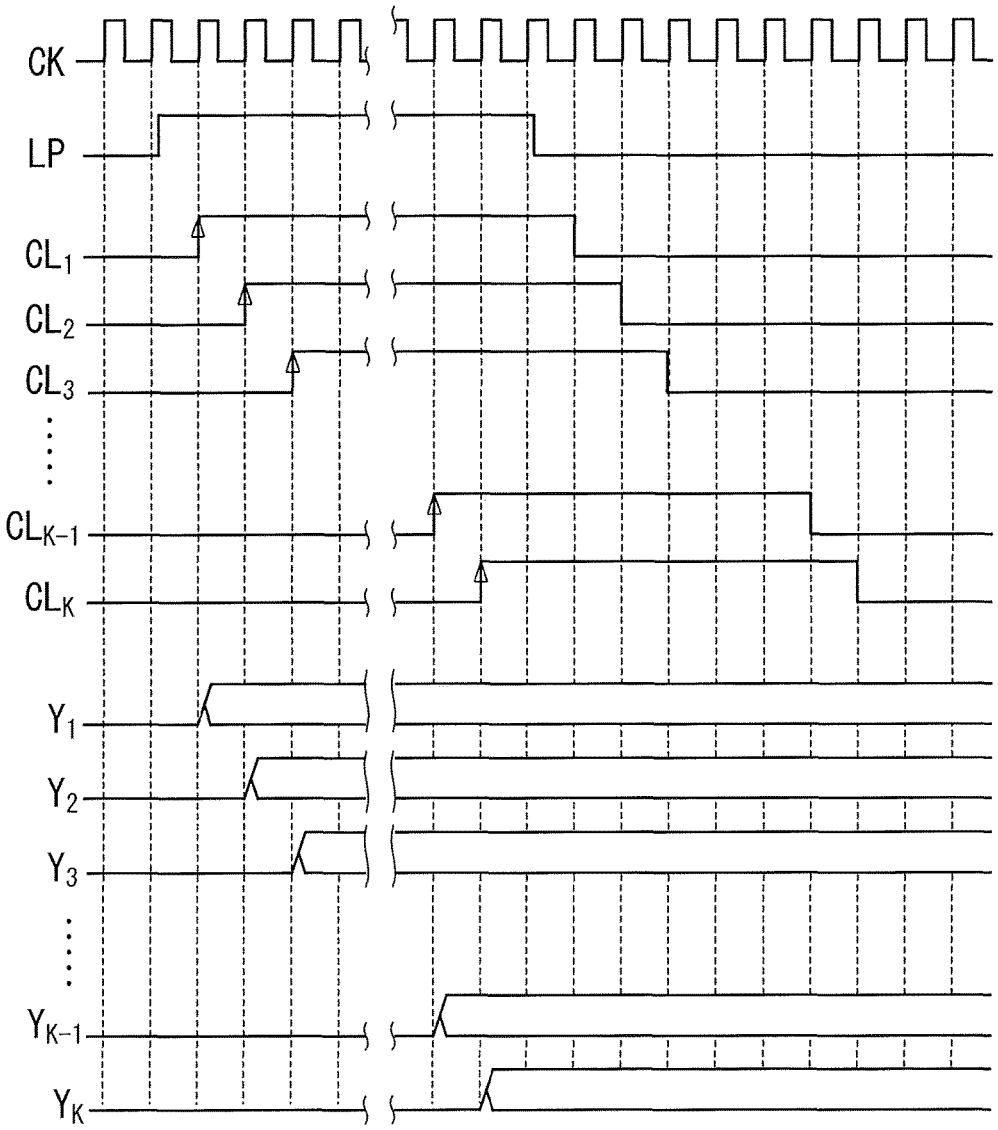
FIG. 5 is a time chart illustrating internal operation of the delay control circuit 134 in the L shift mode.

With this configuration, when the delay mode specified by the delay mode information DM is the L shift mode, a shift direction switch $\mathbf{31}_S$ (S is a natural number of 2 to K) selects a delay capture clock signal $CL_{S-1}$ output from the DFF $\mathbf{32}_{S-1}$ in accordance with the switching signal C1 or C2 with a logic level 0, and supplies the selected signal to the DFF $\mathbf{32}_S$ as illustrated in FIG. 4. Furthermore, in this L shift mode, the shift direction switch $\mathbf{31}_1$ selects the load signal LP and supplies the load signal LP to the DFF $\mathbf{32}_1$. As a result, in the L shift mode, the load signal LP is first captured into the DFF $\mathbf{32}_1$ in synchronization with the reference clock signal CK and then continues to be captured while being shifted to subsequent DFFs in order of the DFFs $\mathbf{32}_2$, $\mathbf{32}_3$, . . . , $\mathbf{32}_{K-1}$, and $\mathbf{32}_K$ in synchronization with the reference clock signal CK. As a consequence, the DFFs $\mathbf{32}_1$ to $\mathbf{32}_K$ generate delay capture clock signals $CL_1$ to $CL_K$ with their edge timing sequentially delayed by one cycle of the reference clock signal CK in order of $CL_1$, $CL_2$, $CL_3$, . . . , $CL_{K-1}$, and $CL_K$ as illustrated in FIG. 5. The DFFs $\mathbf{32}_1$ to $\mathbf{32}_K$ then supply the generated signals to the second latch part 133.

Figure 6:
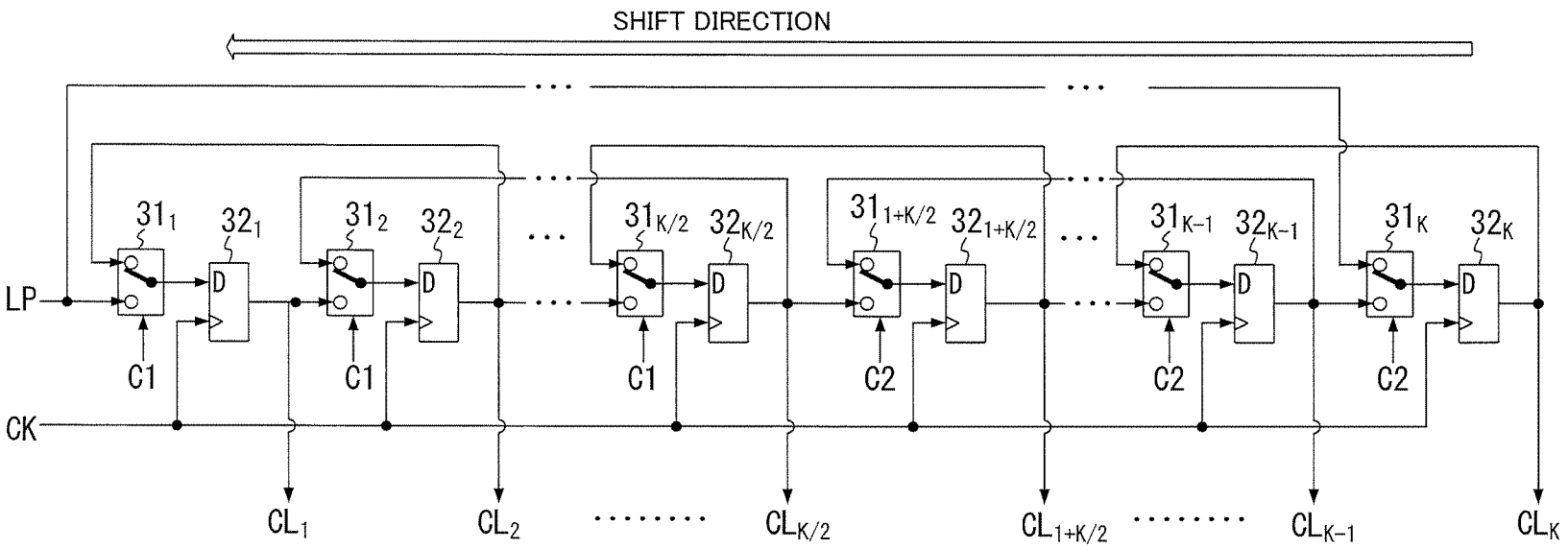
FIG. 6 illustrates the switch states of the shift direction switches $\mathbf{31}_1$ to $\mathbf{31}_K$ in R shift mode.
Figure 7:
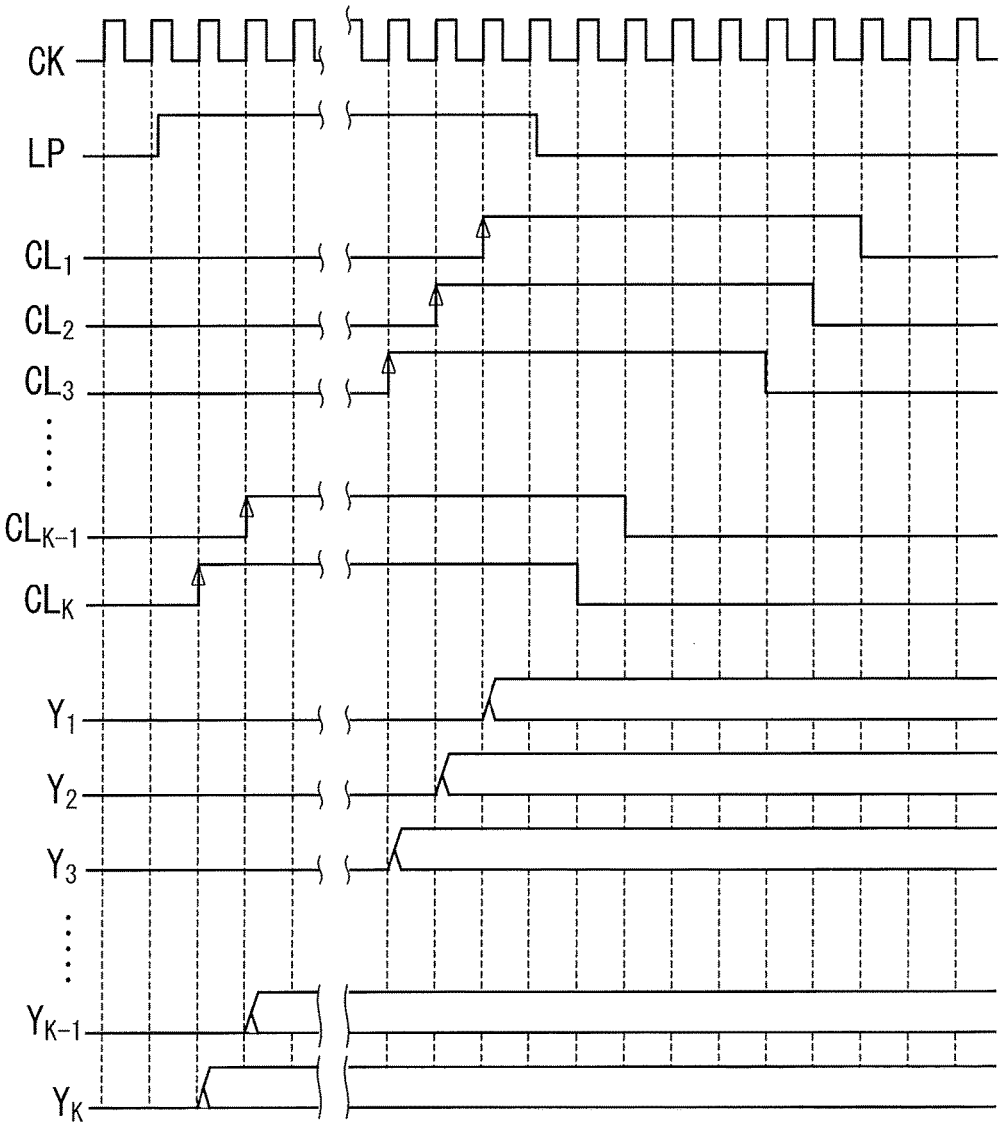
FIG. 7 is a time chart illustrating internal operation of the delay control circuit 134 in the R shift mode.

When the delay mode specified by the delay mode information DM is the R shift mode, a shift direction switch $\mathbf{31}_J$ (J is a natural number of 1 to K−1) selects a delay capture clock signal $CL_{J+1}$ output from the DFF $\mathbf{32}_{J+1}$ in accordance with the switching signal C1 or C2 with a logic level 1, and supplies the selected signal to the DFF $\mathbf{32}_J$ as illustrated in FIG. 6. Furthermore, in this R shift mode, the shift direction switch $\mathbf{31}_K$ selects the load signal LP and supplies the load signal LP to the DFF $\mathbf{32}_{K-1}$. As a consequence, in the R shift mode, the load signal LP is first captured into the DFF $\mathbf{32}_K$ in synchronization with the reference clock signal CK, and then continues to be captured while being sequentially shifted to subsequent DFFs in order of $\mathbf{32}_{K-1}$, $\mathbf{32}_{K-2}$, . . . , $\mathbf{32}_3$, $\mathbf{32}_2$ and $\mathbf{32}_1$ in synchronization with the reference clock signal CK. As a consequence, the DFFs $\mathbf{32}_1$ to $\mathbf{32}_K$ generate delay capture clock signals $CL_1$ to $CL_K$ with their edge timing sequentially delayed by one cycle of the reference clock signal CK in order of $CL_K$, $CL_{K-1}$, . . . , $CL_3$, $CL_2$, and $CL_1$ as illustrated in FIG. 7. The DFFs $\mathbf{32}_1$ to $\mathbf{32}_K$ then supply the generated signals to the second latch part 133.

Figure 8:
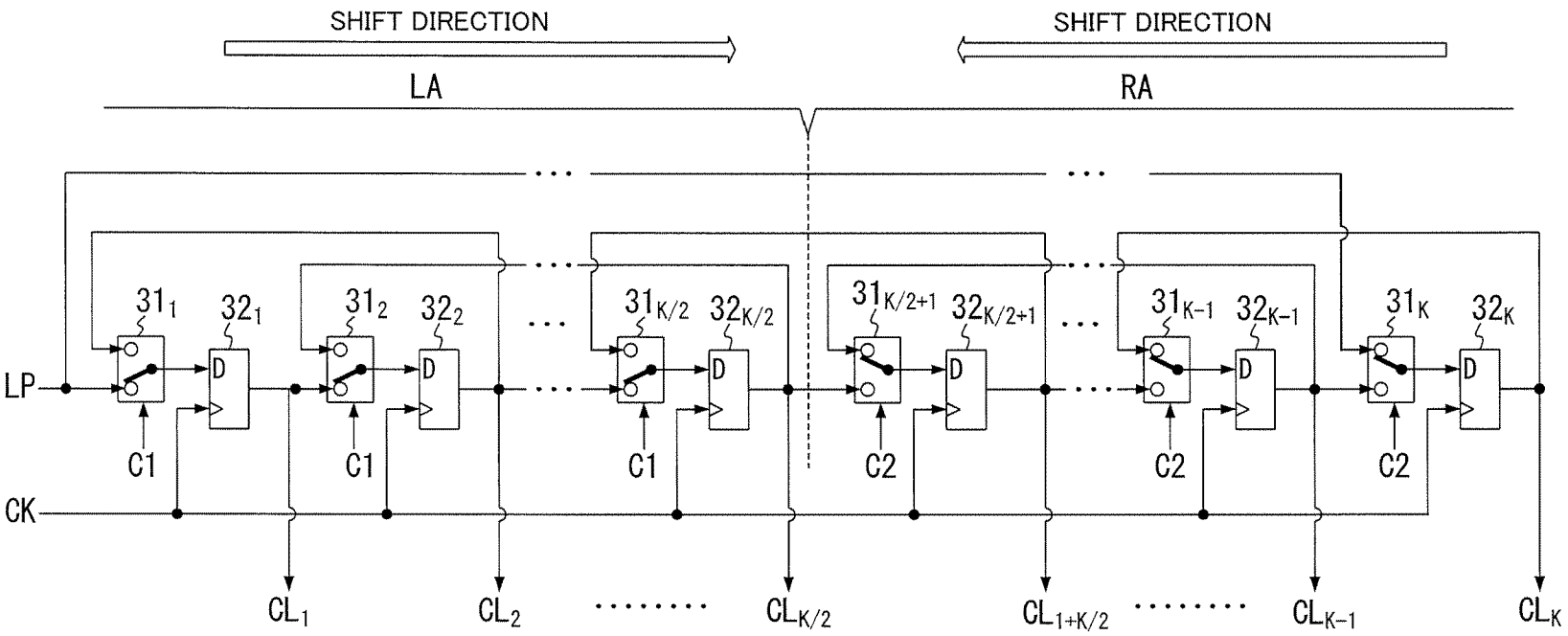
FIG. 8 illustrates switch states of the shift direction switches $\mathbf{31}_1$ to $\mathbf{31}_K$ in V shift mode.
Figure 9:
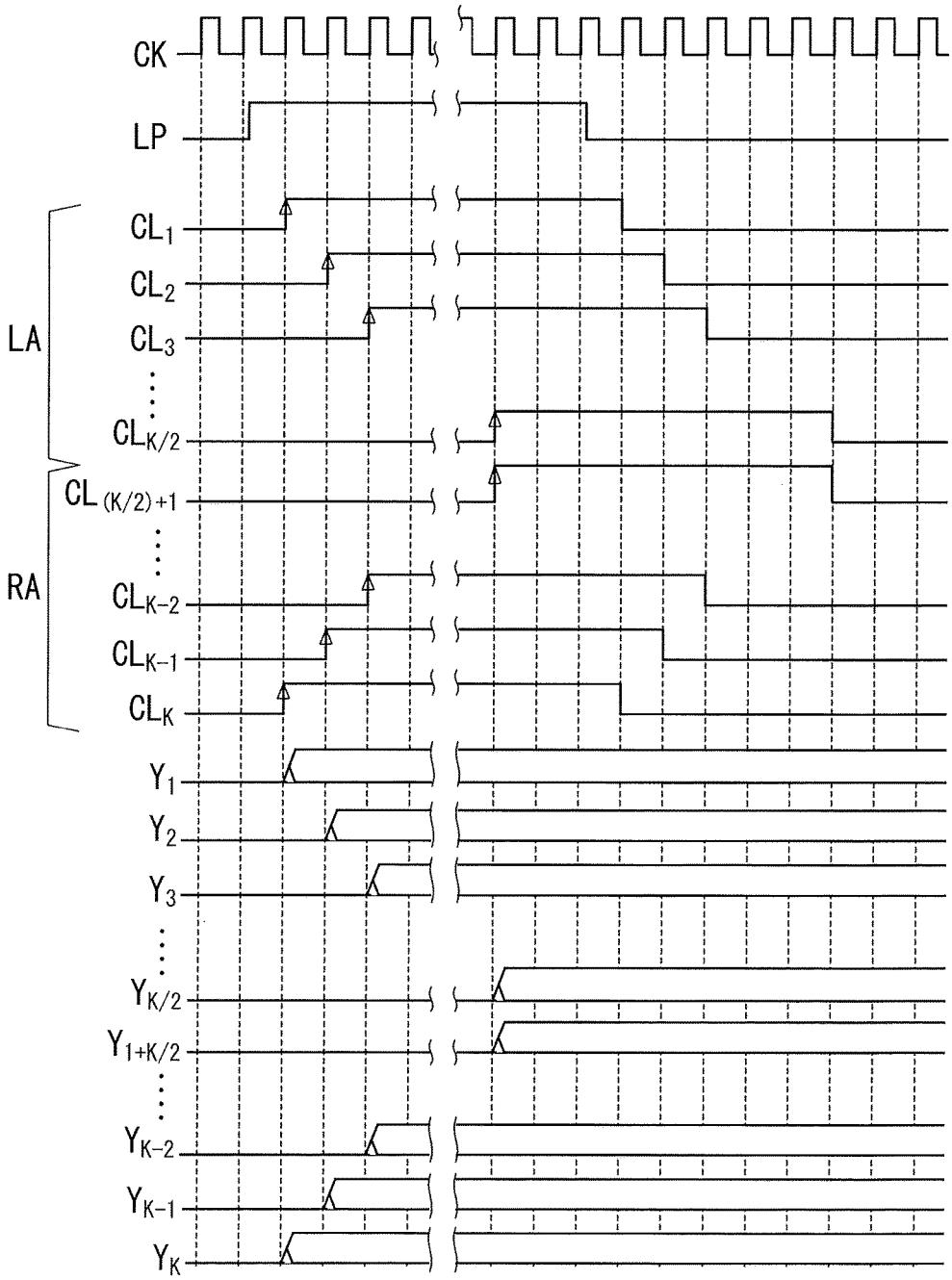
FIG. 9 is a time chart illustrating internal operation of the delay control circuit 134 in the V shift mode.

When the delay mode specified by the delay mode information DM is V shift mode, a shift direction switch $\mathbf{31}_T$ (T is a natural number of 2 to K/2) belonging to a left area LA among the shift direction switches $\mathbf{31}_1$ to $\mathbf{31}_K$ selects a delay capture clock signal $CL_{T-1}$ output from a DFF $\mathbf{32}_{T-1}$, and supplies the selected signal to a DFF $\mathbf{32}_T$ as illustrated in FIG. 8. Furthermore, in this V shift mode, the shift direction switch $\mathbf{31}_1$ belonging to the left area LA selects the load signal LP and supplies the load signal LP to the DFF $\mathbf{32}_1$. In the V shift mode, a shift direction switch $\mathbf{31}_H$ (H is a natural number of 1+K/2 to K−1) belonging to a right area RA among the shift direction switches $\mathbf{31}_1$ to $\mathbf{31}_K$ selects a delay capture clock signal $CL_{H+1}$ output from a DFF $\mathbf{32}_{H+1}$, and supplies the selected signal to a DFF $\mathbf{32}_H$. Furthermore, in this V shift mode, the shift direction switch $\mathbf{31}_K$ belonging to the right area RA selects the load signal LP and supplies the load signal LP to the DFF $\mathbf{32}_K$. Accordingly, in the V shift mode, the load signal LP is first captured into each of the DFFs $\mathbf{32}_1$ and $\mathbf{32}_K$ in synchronization with the reference clock signal CK, and then continues to be captured into each of the DFFs 32 which belong to the left area LA and the right area RA in synchronization with the reference clock signal CK as described below. That is, in the left area LA, the load signal LP is captured while being shifted to subsequent DFFs in order of the DFFs $\mathbf{32}_2$, $\mathbf{32}_3$, . . . , $\mathbf{32}_{(K/2)-1}$, and $\mathbf{32}_{K/2}$. In the right area RA, the load signal LP is captured while being shifted to subsequent DFFs in order of DFFs $\mathbf{32}_{K-1}$, $\mathbf{32}_{K-2}$, $\mathbf{32}_{K-3}$, . . . , and $\mathbf{32}_{(K/2)+1}$. As a consequence, the DFFs $\mathbf{32}_1$ to $\mathbf{32}_{K/2}$ belonging to the left area LA generate delay capture clock signals $CL_1$ to $CL_{K/2}$ with their edge timing sequentially delayed by one cycle of the reference clock signal CK in order of $CL_1$, $CL_2$, $CL_3$, . . . , and $CL_{K/2}$ as illustrated in FIG. 9. The DFFs $\mathbf{32}_1$ to $\mathbf{32}_{K/2}$ then supply the generated signals to the second latch part 133. The DFF $\mathbf{32}_{(K/2)+1}$, $\mathbf{32}_{(K/2+2}$, . . . $\mathbf{32}_{K-1}$, and $\mathbf{32}_K$ belonging to the right area RA generate delay capture clock signals $CL_{(K/2)+1}$ to $CL_K$ with their edge timing sequentially delayed by one cycle of the reference clock signal CK in order of $CL_K$, $CL_{K-1}$, $CL_{K-2}$, . . . , and $CL_{(K/2)+1}$ as illustrated in FIG. 9. The DFFs $\mathbf{32}_{(K/2)+1}$ to $\mathbf{32}_K$ then supply the generated signals to the second latch part 133.

The second data latch part 133 has K latches $\mathbf{33}_1$ to $\mathbf{33}_K$. The latches $\mathbf{33}_1$ to $\mathbf{33}_K$ individually capture pixel data $R_1$ to $R_K$ supplied from the first data latch part 132 in synchronization with the above-stated delay capture clock signals $CL_1$ to $CL_K$, and supply the respective captured pixel data $R_1$ to $R_K$ as pixel data $Y_1$ to $Y_K$ to the gradation voltage conversion circuit 135.

The gradation voltage conversion circuit 135 converts the pixel data $Y_1$ to $Y_K$ into pixel drive voltages $V_1$ to $V_K$ having voltage values corresponding to their luminance levels, and supplies the pixel drive voltages $V_1$ to $V_K$ to the output amplifier circuit 136. The output amplifier circuit 136 amplifies each of the pixel drive voltages $V_1$ to $V_K$ to desired values, and applies the amplified pixel drive voltages $V_1$ to $V_K$ as pixel drive voltages $G_1$ to $G_K$ to data lines $D_1$ to $D_K$ of the display device 20, respectively.

Figure 10A:
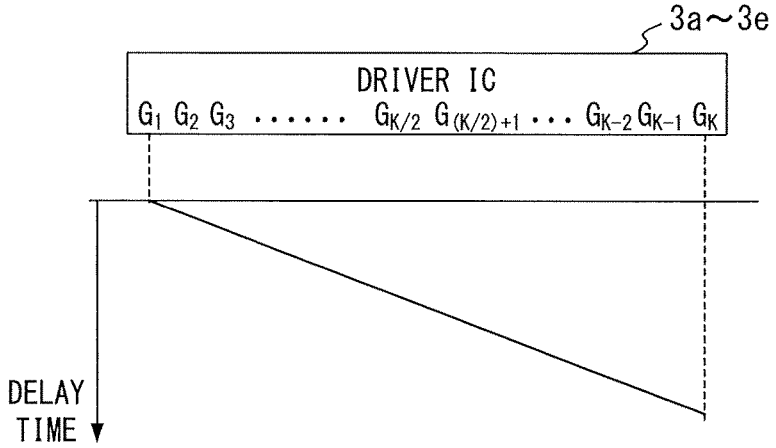
FIGS. 10A, 10B, and 10C illustrate the configuration of delay in the pixel drive voltages G applied to respective data lines in each delay mode.
Figure 10B:
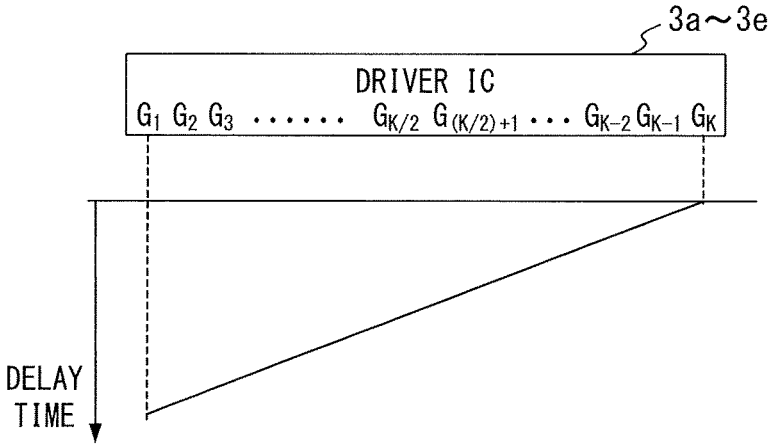
Figure 10C:
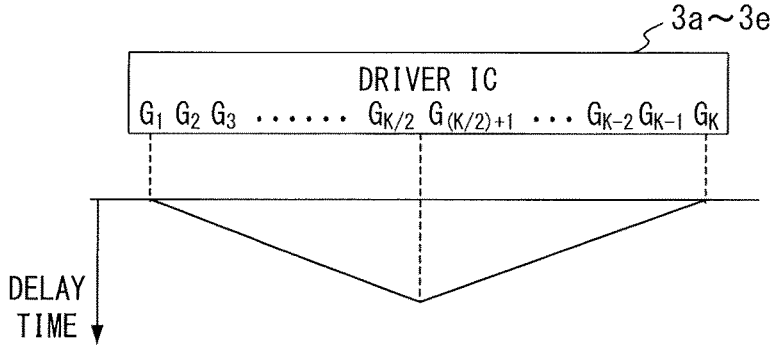

With the above configuration, the driver ICs 3*a* to 3*e* each apply the above-stated pixel drive voltages $G_1$ to $G_K$ to the respective data lines D of the display device 20 when the load delay time represented by the load delay time information LI is passed after reception of the load signal LD and then the delay time based on the delay mode specified by the delay mode information DM is further passed. For example, when the delay mode specified by the delay mode information DM is the L shift mode, the driver ICs 3*a* to 3*e* each apply the respective pixel drive voltages G to the data lines D at application timing delayed in order of the pixel drive voltages $G_1$, $G_2$, $G_3$, . . . , and $G_K$ as illustrated in FIG. 10A. When the delay mode is the R shift mode, the driver ICs 3*a* to 3*e* each apply the respective pixel drive voltages G to the data lines D at application timing delayed in order of the pixel drive voltages $G_K$, $G_{K-1}$, $G_{K-2}$, . . . , $G_2$ and $G_1$ as illustrated in FIG. 10B. When the delay mode is the V shift mode, the driver ICs 3*a* to 3*e* each apply the respective pixel drive voltages G to the data lines D at application timing delayed in order of the pixel drive voltages ($G_1$, $G_K$), ($G_2$, $G_{K-1}$) ($G_3$, $G_{K-2}$) . . . ($G_{K/2}$, $G_{(K/2)+1}$) as illustrated in FIG. 10C.

A description is now given of the operation by the above-stated drive controller 1 and the driver ICs 3*a* to 3*e*.

First, the drive controller 1 supplies an initial setting signal ISS, which is used for initial setting of each of the driver ICs 3*a* to 3*e* of the data driver 3, to the data driver 3.

More specifically, the drive controller 1 supplies to the driver ICs 3*a* and 3*b* which drive the screen left area of the display device 20, an initial setting signal ISS including delay mode information DM for specifying the L shift mode. The drive controller 1 supplies to the driver IC 3*a* placed in the leftmost end, an initial setting signal ISS further including load delay time information LI indicative of the load delay time of zero, i.e., no delay time. The drive controller 1 supplies to the driver IC 3*b* placed next to the left end, an initial setting signal ISS further including load delay time information LI indicative of load delay time T1. The load delay time T1 is, for example, a period of time from supply point of the delayed load signal LD to start point of application of the pixel drive voltage G which is applied the latest in the driver IC 3*a* adjacent to the driver IC 3*b* on the left side.

The drive controller 1 supplies to the driver IC 3*c* which drives the screen center area of the display device 20, an initial setting signal ISS including delay mode information DM for specifying the V shift mode and load delay time information LI indicative of the load delay time T2. The load delay time T2 is, for example, a period of time from supply point of the delayed load signal LD to start point of application of the pixel drive voltage G which is applied the latest in the driver IC 3*b* adjacent to the driver IC 3*c* on the left side.

The drive controller 1 supplies to the driver ICs 3*d* and 3*e* which drive the screen right area of the display device 20, an initial setting signal ISS including delay mode information DM for specifying the R shift mode. The drive controller 1 supplies to the driver IC 3*e* placed in the rightmost end, an initial setting signal ISS further including load delay time information LI indicative of the load delay time of zero, i.e., no delay time. The drive controller 1 supplies to the driver IC 3*d* placed next to the right end, an initial setting signal ISS further including load delay time information LI indicative of load delay time T2. The load delay time T2 is, for example, a period of time from supply point of the delay load signal LD to start point of application of the pixel drive voltage G which is applied the latest in the driver IC 3*e* adjacent to the driver IC 3*d* on the right side.

Figure 11:
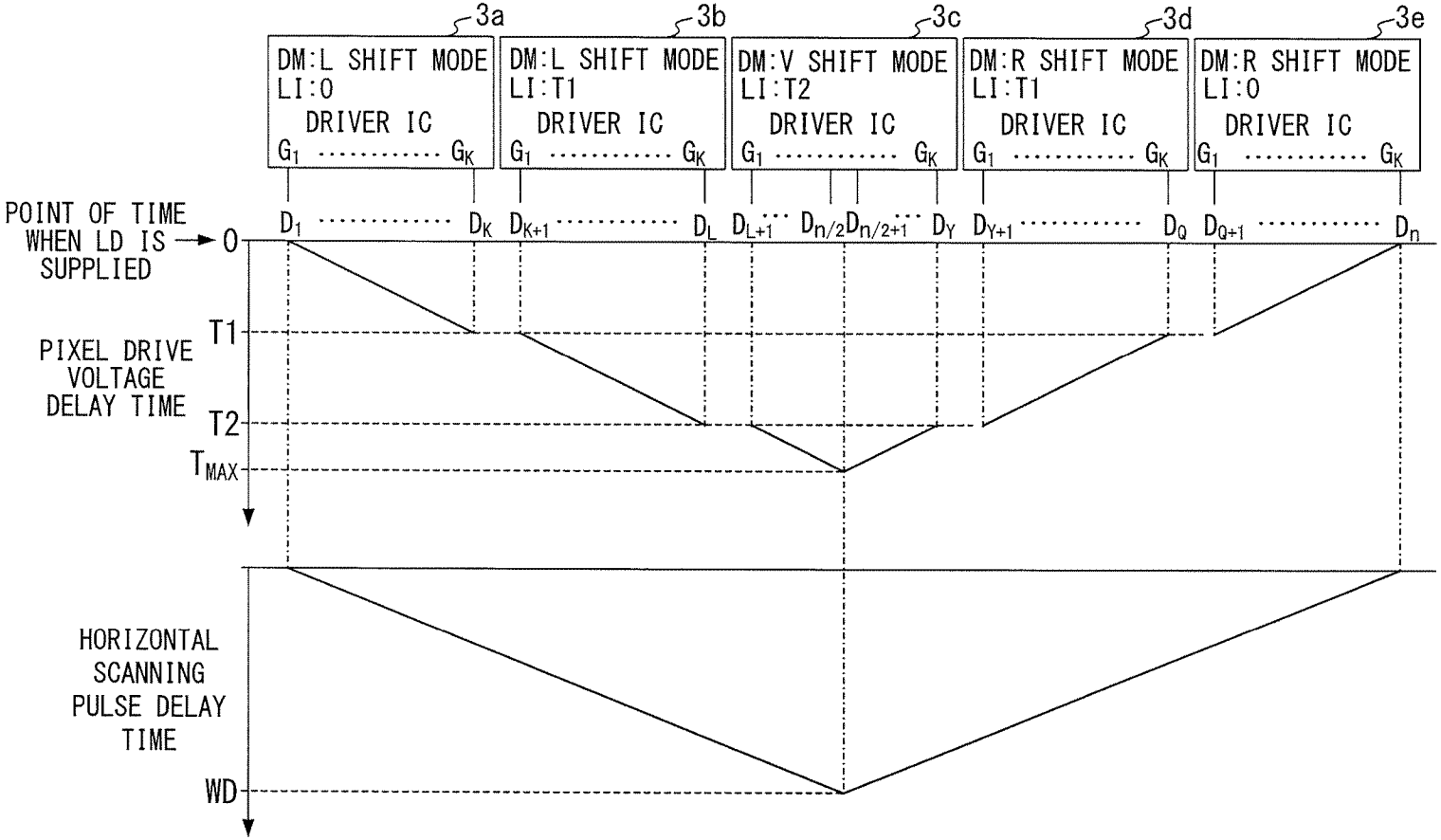
FIG. 11 illustrates the configuration of delay in the pixel drive voltages G applied to data lines $D_1$ to $D_n$ and the configuration of delay in a horizontal scanning pulse at each position on horizontal scan lines S.

Once the initial setting is performed on the basis of the above-stated initial setting signal ISS, the driver ICs 3*a* to 3*e* apply to each of the data lines D connected to the respective driver ICs, the pixel drive voltages G with the delay configured in accordance with the load delay time information LI and the delay mode information DM as illustrated in FIG. 11.

More specifically, first, in response to the load signal LD supplied from the drive controller 1, the driver ICs 3*a* and 3*e*, among the driver ICs 3*a* to 3*e*, start application of the pixel drive voltages G to the respective data lines D. In accordance with the L shift mode illustrated in FIG. 10A, the driver IC 3*a* sequentially applies pixel drive voltages $G_1$ to $G_K$ with their application timing delayed in order of $G_1$, $G_2$, $G_3$, . . . and $G_K$ to the data lines $D_1$, $D_2$, $D_3$, . . . and $D_K$ of the display device 20 as illustrated in FIG. 11. In accordance with the R shift mode illustrated in FIG. 10B, the driver IC 3*e* sequentially applies pixel drive voltages $G_1$ to $G_K$ with their application timing delayed in order of $G_K$, $G_{K-1}$, $G_{K-2}$, . . . $G_2$ and $G_1$ to the data lines $D_n$, $D_{n-1}$, $D_{n-2}$, . . . , $D_{Q+1}$ as illustrated in FIG. 11.

Once the load delay time TI represented by the load delay time information LI is passed after the point of time when the load signal LD is supplied, the driver ICs 3*b* and 3*d* start application of the pixel drive voltages G to the respective data lines D. In accordance with the L shift mode illustrated in FIG. 10A, the driver IC 3*b* sequentially applies pixel drive voltages $G_1$ to $G_K$ with their application timing delayed in order of $G_1$, $G_2$, $G_3$, . . . and $G_K$ to the data lines $D_{K+1}$, $D_{K+2}$, $D_{K+3}$, . . . , $D_L$ of the display device 20 as illustrated in FIG. 11. In accordance with the R shift mode illustrated in FIG. 10B, the driver IC 3*d* sequentially applies pixel drive voltages $G_1$ to $G_K$ with their application timing delayed in order of $G_K$, $G_{K-1}$ $G_{K-2}$, . . . $G_2$ and $G_1$ to the data lines $D_Q$, $D_{Q-1}$, $D_{Q-2}$, . . . , $D_{Y+2}$, and $D_{Y+1}$ of the display device 20 as illustrated in FIG. 11.

Once the load delay time T2 represented by the load delay time information LI is passed after the point of time when the load signal LD is supplied, the driver IC 3*c* starts application of the pixel drive voltages G to the respective data lines D. More specifically, in accordance with the V shift mode illustrated in FIG. 10C, the driver IC 3*c* sequentially applies pixel drive voltages $G_1$ to $G_K$ with their application timing delayed in order of ($G_1$, $G_K$), ($G_2$, $G_{K-1}$), ($G_3$, $G_{K-2}$), . . . and ($G_{K/2}$, $G_{(K/2)+1}$) to the data lines ($D_{L+1}$, $D_Y$), ($D_{L+2}$, $D_{Y-1}$), ($D_{L+3}$, $D_{Y-2}$), . . . , and ($D_{n/2}$, $D_{(n/2)+1}$) of the display device 20 as illustrated in FIG. 11.

When a horizontal scanning pulse SP is applied to a horizontal scan line S among the horizontal scan lines $S_1$ to $S_n$ of the display device 20, the display cells belonging to the horizontal scan line S perform display with luminance levels corresponding to the pixel drive voltages G applied to each of the data lines $D_1$ to $D_n$.

Figure 12:
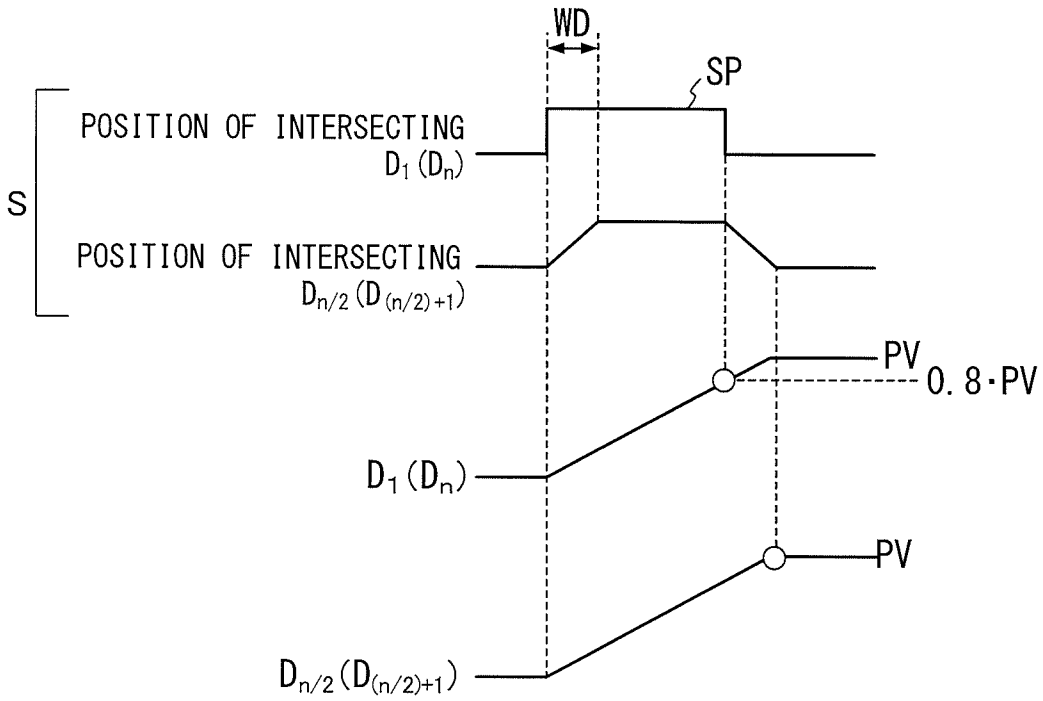
FIG. 12 is a waveform chart illustrating pixel drive voltages and horizontal scanning pulses when the pixel drive voltages are simultaneously applied to a data line $D_1$ (or $D_n$) belonging to a screen left (or right) end area and a data line $D_{n/2}$ (or $D_{(n/2)+1}$) belonging to a screen center area.

As the size of the display device 20 increases, the interconnection resistance of the horizontal scan lines S extending in the horizontal direction of the two-dimensional screen becomes larger in particular. Accordingly, in order to reduce the load of the scanning drivers caused by the interconnection resistance, the scanning drivers (2A, 2B) are provided on both ends of the horizontal scan lines S in the display apparatus illustrated in FIG. 1. On each of the horizontal scan lines $S_1$ to $S_m$, a delay amount of the horizontal scanning pulse SP attributable to the interconnection resistance is larger at the positions more distant from both the scanning drivers 2A and 2B, i.e., at the positions closer to the screen center. Therefore, when the scanning drivers 2A and 2B apply the horizontal scanning pulse SP to the horizontal scan lines S, the horizontal scanning pulse SP reaches a crossing part between the horizontal scan line S and a data line $D_{n/2}$ (or $D_{(n/2)+1}$) belonging to the screen center area later by time WD than the horizontal scanning pulse SP reaching a crossing part between the horizontal scan line S and the data line $D_1$ (or $D_n$) belonging to the screen left (or right) end area as illustrated in FIG. 12, for example. In this case, if the data driver 3 simultaneously applies the same pixel drive voltage G to the data line $D_1$ (or $D_n$) and the data line $D_{n/2}$ (or $D_{(n/2)+1}$) in synchronization with application of the horizontal scanning pulse SP, the pixel drive voltage G applied to both the data lines D rises gradually and reaches a desired peak voltage PV at substantially the same timing as illustrated in FIG. 12. For example, as illustrated in FIG. 12, in the display cell at the crossing part between the horizontal scan line S and the data line $D_1$ (or $D_n$), display is performed with a luminance level corresponding to 80% of the maximum value of the pixel drive voltage G applied to the data line $D_1$ (or $D_n$), i.e., the peak voltage PV of the pixel drive voltage G, while the horizontal scanning pulse SP is applied to the horizontal scan line S. The horizontal scanning pulse SP reaches the display cell at the crossing part between the horizontal scan line S and the data line $D_{n/2}$ (or $D_{(n/2)+1}$) with a delay of the time WD. Accordingly, as illustrated in FIG. 12 for example, the voltage value of the pixel drive voltage G applied to the data line $D_{n/2}$ (or $D_{(n/2)+1}$) reaches the peak voltage PV while the horizontal scanning pulse SP is applied. Therefore, in the display cell at the crossing part between the horizontal scan line S and the data line $D_{n/2}$ (or $D_{(n/2)+1}$), display is performed with a luminance level corresponding to the maximum value of the pixel drive voltage G applied to the data line $D_1$ (or $D_n$), i.e., the peak voltage PV of the pixel drive voltage G, while the horizontal scanning pulse SP is applied to the horizontal scan line S as illustrated in FIG. 12. Consequently, the display luminance of the display cell connected to the data line $D_1$ (or $D_n$) belonging to the screen left (or right) end area and the display luminance of the display cell connected to the data line $D_{n/2}$ (or $D_{(n/2)+1}$) belonging to the screen center area do not coincide, which results in occurrence of display unevenness.

The data driver 3 applies the pixel drive voltages G to the data lines D that intersect the horizontal scan lines S at the positions where delay time is larger, at timing later than timing of applying the pixel drive voltages to the data lines D that intersect the scanning lines S at positions where the delay time is smaller, the delay time being a period of time from start point of application of the horizontal scanning pulse SP by the scanning drivers 2A and 2B to actual arrival point of the scanning pulse SP. For example, as illustrated in FIG. 1, when the scanning drivers 2A and 2B are each placed on both ends of the horizontal scan lines S, the delay time until arrival of the horizontal scanning pulse SP on the horizontal scan lines S becomes larger from the screen right or left end area toward the screen center area as illustrated in FIG. 11. In conformity with the pattern of the delay time of the horizontal scanning pulse SP, the data driver 3 delays the application timing of the pixel drive voltages G more as the data lines D are closer to the screen center where the delay time until the arrival of the horizontal scanning pulse SP is larger as illustrated in FIG. 11.

Figure 13:
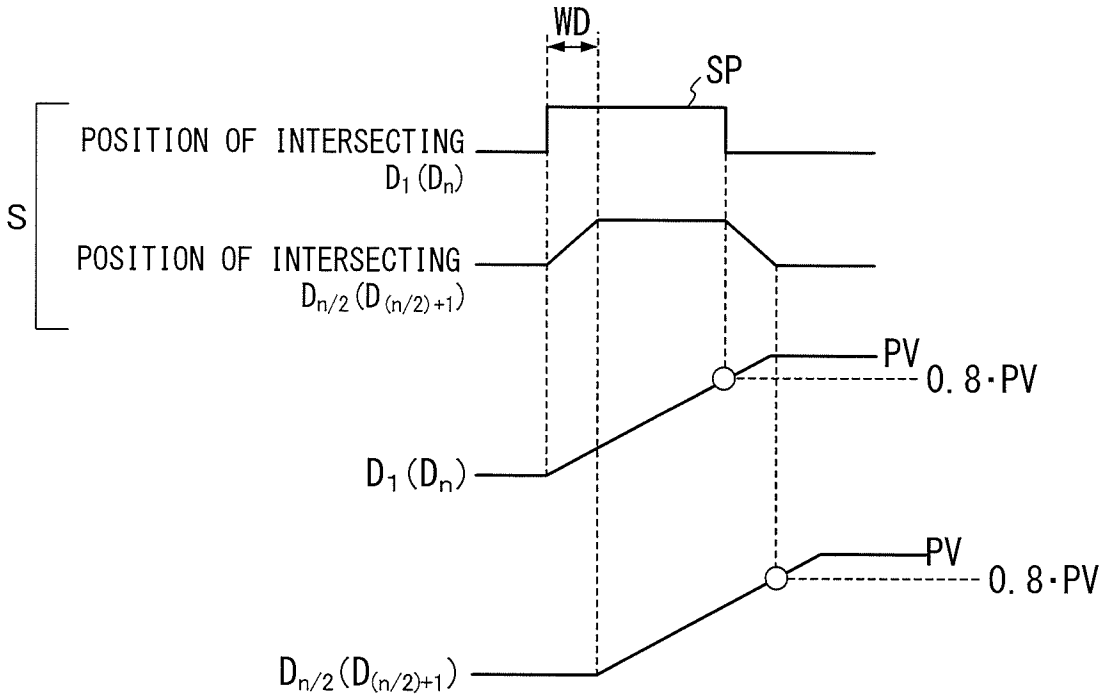
FIG. 13 is a waveform chart illustrating a pixel drive voltage and a horizontal scanning pulse when the pixel drive voltage applied to the data line $D_{n/2}$ (or $D_{(n/2)+1}$) belonging to the screen center area is delayed from the pixel drive voltage applied to the data line $D_1$ (or $D_n$) belonging to the screen left (or right) end area.

For example, as illustrated in FIG. 13, when the horizontal scanning pulse SP reaches a crossing position between the data line $D_{n/2}$ (or $D_{(n/2)+1}$) belonging to the screen center area and the horizontal scanning line S later by time WD than the horizontal scanning pulse SP reaching a crossing position between the data line $D_1$ (or $D_n$) belonging to the screen left (or right) end area and the horizontal scanning line S, the timing of applying the pixel drive voltage G to the data line $D_{n/2}$ (or $D_{(n/2)+1}$) is delayed by the time WD.

As a consequence, as illustrated in FIG. 13, in both the display cell connected to the data line $D_1$ (or $D_n$) and the display cell connected to the data line $D_{n/2}$ (or $D_{(n/2)+1}$), display is performed with a luminance level corresponding to 80% of the peak voltage PV of the pixel drive voltage G. As a result, the display unevenness within the screen is reduced.

As illustrated in FIG. 11, since the data driver 3 shifts the timing of applying the pixel drive voltages G to the respective data lines D, the situation where steep change in currents that flow into the respective data lines simultaneously occurs can be avoided and thereby the noise generated in such a situation can be suppressed.

Therefore, the data driver 3 can suppress the display unevenness in the screen attributed to a difference in arrival delay time of the horizontal scanning pulse SP at the respective positions on the horizontal scan lines S, while avoiding the situation of steep and simultaneous change in currents that flow into the respective data lines, so that the noise generated in such a situation can be suppressed.

In order to shift the timing of applying the pixel drive voltages G to the respective data lines D, the driver ICs 3*a* to 3*e* of the data driver 3 supply delay capture clock signals $CL_1$ to $CL_K$ having rising (or falling) edge timing different from each other as illustrated in FIG. 5, to the respective clock input terminals of latches $\mathbf{33}_1$ to $\mathbf{33}_K$ of the second data latch part 133, respectively. To generate delay capture clock signals $CL_1$ to $CL_K$, the driver ICs 3*a* to 3*e* each have a shift register that includes DFFs $\mathbf{32}_1$ to $\mathbf{32}_K$ of a clock synchronization scheme. The DFFs $\mathbf{32}_1$ to $\mathbf{32}_K$ are connected in series and are each operative with the reference clock signal CK as illustrated in FIG. 3. Outputs of the respective DFFs $\mathbf{32}_1$ to $\mathbf{32}_K$ in this shift register are supplied to the respective clock input terminals of the latches $\mathbf{33}_1$ to $\mathbf{33}_K$ as delay capture clock signals $CL_1$ to $CL_K$.

Therefore, according to the configuration illustrated in FIG. 3, it becomes possible to suppress variations in the delay amount of the respective delay capture clock signals CL caused by the influence of manufacturing variations, environmental temperature, and the like, as compared with the case where delay capture clock signals CL different in edge timing are generated by utilizing output delay of the elements such as inverter elements themselves.

According to the configuration illustrated in FIG. 3, the delay amount of the respective delay capture clock signals CL can be adjusted by changing the frequency of the reference timing signal RS supplied from the outside of the driver ICs 3*a* to 3*e*. This makes it possible to adapt to the specifications of various display devices. Therefore, according to the above-stated configuration, it becomes possible to provide a versatile driver which suppresses the noise generated in occasion of steep and simultaneous change in currents that flow into respective data lines, the versatile driver being resistant to the influence of manufacturing variations, environmental temperature, and the like, and adaptable to the specifications of various kinds of display devices.

In the configuration illustrated in FIG. 3, the delay capture clock signals $CL_1$ to $CL_K$ different in timing from each other are generated by using a single shift register ($\mathbf{31}_1$ to $\mathbf{31}_K$, $\mathbf{32}_1$ to $\mathbf{32}_K$) and a single clock signal (CK). However, the above-stated delay capture clock signals $CL_1$ to $CL_K$ may be generated by using a plurality of shift registers operative with clock signals different in phase from each other.

Figure 14:
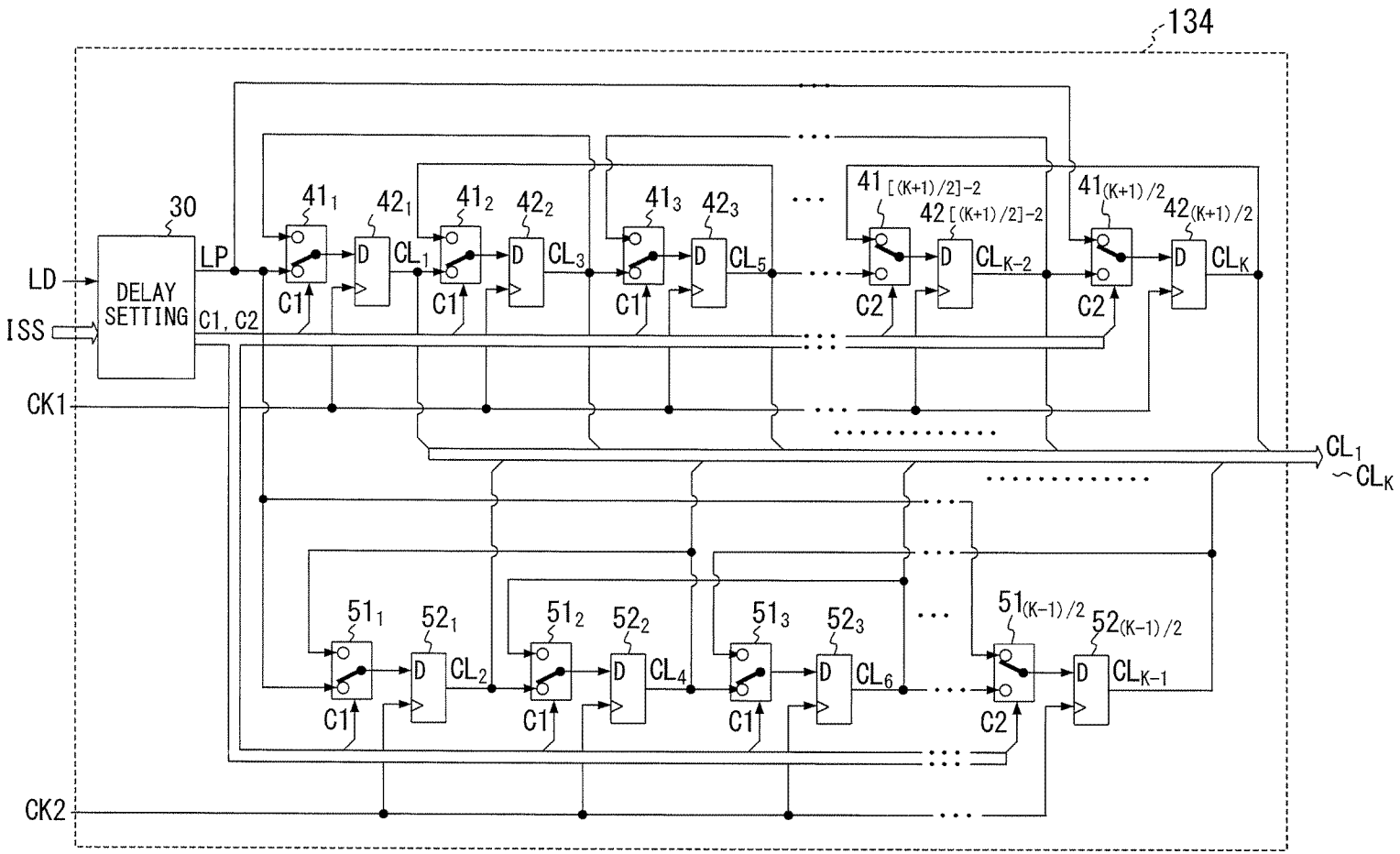
FIG. 14 is a circuit diagram illustrating another example of the internal configuration of the delay control circuit 134.
Figure 15:
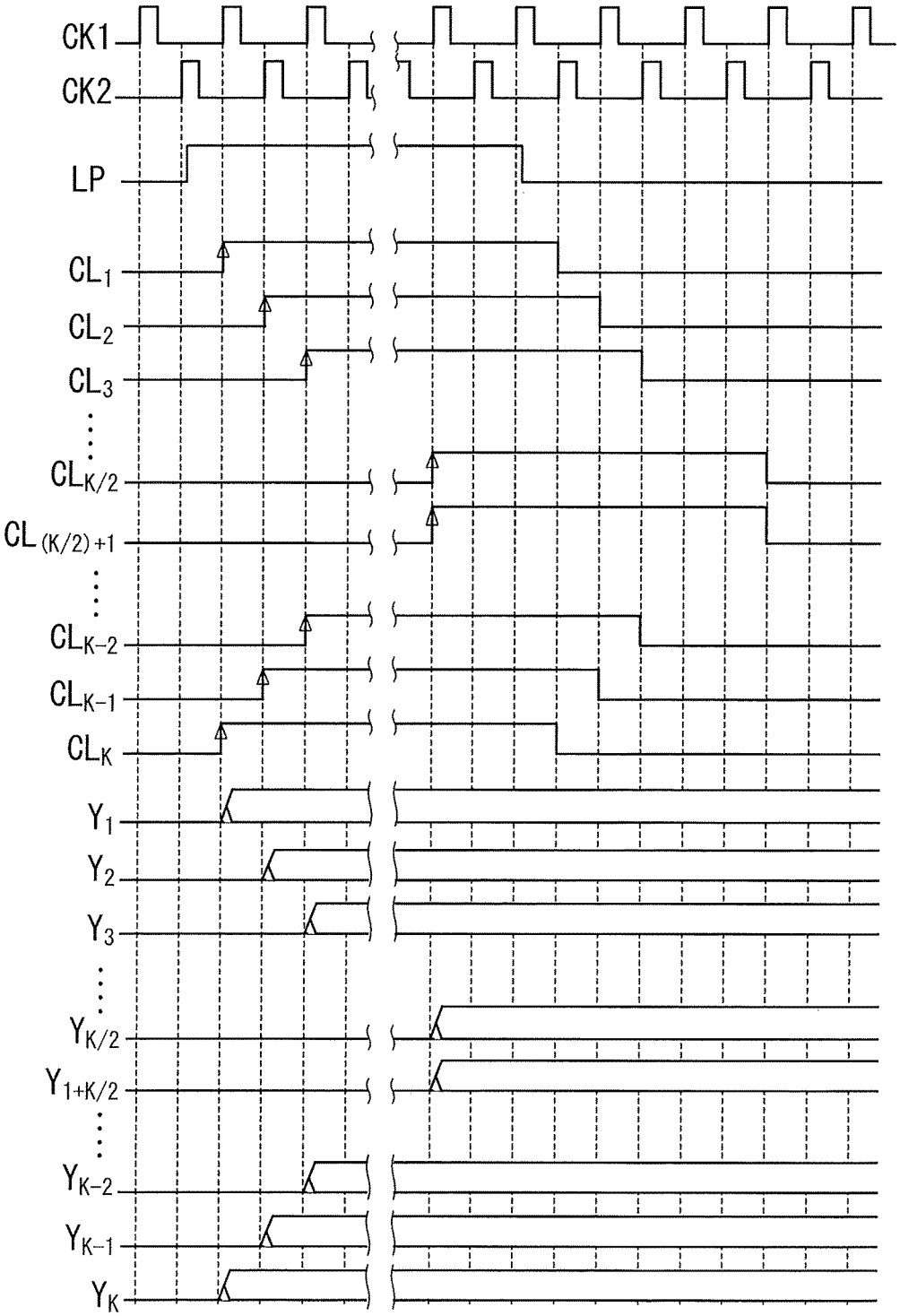
FIG. 15 is a time chart illustrating internal operation at the time of operating the delay control circuit 134 illustrated in FIG. 14 in the V shift mode.

FIG. 14 is a circuit diagram illustrating another example of the internal configuration of the delay control circuit 134 made in view of this point. In the configuration illustrated in FIG. 14, a single shift resister including the above-stated shift direction switches $\mathbf{31}_1$ to $\mathbf{31}_K$ and the DFFs $\mathbf{32}_1$ to $\mathbf{32}_K$ are divided into a first shift register including shift direction switches $\mathbf{41}_1$ to $\mathbf{41}_{(K+1)/2}$, and DFFs $\mathbf{42}_1$ to $\mathbf{42}_{(K+1)/2}$, and a second shift register including shift direction switches $\mathbf{51}_1$ to $\mathbf{51}_{(K-1)/2}$, and DFFs $\mathbf{52}_1$ to $\mathbf{52}_{(K-1)/2}$. The delay setting part 30 illustrated in FIG. 3 is used in this configuration without any change. The receiving circuit 131 generates reference clock signals CK1 and CK2 in place of the single reference clock signal CK. The reference clock signals CK1 and CK2 have a frequency that is half the frequency of the reference clock signal CK, and their phases are different from each other as illustrated in FIG. 15. The receiving circuit 131 supplies the reference clock signal CK1 to the DFFs $\mathbf{42}_1$ to $\mathbf{42}_{(K+1)/2}$ of the first shift register, and supplies the reference clock signal CK2 to the DFFs $\mathbf{52}_1$ to $\mathbf{52}_{(K-1)/2}$ of the second shift register. In response to the load signal LP supplied from the delay setting part 30, shift operation of the first and second shift registers is started at the same time. Accordingly, as illustrated in FIG. 15 for example, the DFFs $\mathbf{42}_1$ to $\mathbf{42}_{(K+1)/2}$ of the first shift register each output odd-numbered delay capture clock signals $CL_1, CL_3, CL_5, \ldots, CL_K$, among the delay capture clock signals $CL_1$ to $CL_K$, in synchronization with the reference clock signal CK1. As illustrated in FIG. 15 for example, the DFFs $\mathbf{52}_1$ to $\mathbf{52}_{(K-1)/2}$ of the second shift register each output even-numbered delay capture clock signals $CL_2$, $=_4$. $CL_6, \ldots, CL_{K-1}$, among the delay capture clock signals $CL_1$ to $CL_K$, in synchronization with the reference clock signal CK2.

Therefore, according to the configuration illustrated in FIG. 14, the frequency of the reference clock signals CK1 and CK2, which operate the first and second shift registers, respectively, is set to half the frequency of the reference clock signal CK supplied to operate the single shift register illustrated in FIG. 3. This increases an operation margin provided to reliably operate the shift registers.

In the embodiment illustrated in FIG. 3, the delay control circuit 134 controls the respective delay amounts of K pixel drive voltages $G_1$ to $G_K$ by using K delay capture clock signals $CL_1$ to $CL_K$. However, the delay control circuit 134 may control the delay amount in units of groups each including two or more pixel drive voltages G. In this case, the number of the delay capture clock signals CL to be generated can be reduced, so that the number of DFFs in the above-stated shift register is also reduced accordingly. As a result, downsizing of the apparatus can be achieved.

In the V shift mode, the above-stated delay control circuit 134 makes the DFFs $\mathbf{32}_1$ to $\mathbf{32}_{K/2}$ belonging to the left area LA capture the load signal LP while shifting the load signal LP to subsequent DFFs in order of $\mathbf{32}_1$ to $\mathbf{32}_{K/2}$. The delay control circuit 134 also makes the DFF $\mathbf{32}_{(K/2)+1}$ to $\mathbf{32}_K$ belonging to the right area RA capture the load signal LP while shifting the load signal LP to the subsequent DFFs in order of $\mathbf{32}_K$ to $\mathbf{32}_{(K/2)+1}$. However, the number of the DFFs 32 belonging to the left area LA (or right area RA) needs not necessarily be K/2. More specifically, in the V shift mode, the DFFs $\mathbf{32}_1$ to $\mathbf{32}_f$ (f is a natural number of 2 or more and less than K) belonging to the left area LA may be configured to capture the load signal LP while shifting the load signal LP to the subsequent DFFs in order of $\mathbf{32}_1$ to $\mathbf{32}_f$, while the DFFs $\mathbf{32}_{f+1}$ to $\mathbf{32}_K$ belonging to the right area RA may be configured to capture the load signal LP while shifting the load signal LP to the subsequent DFFs in order of $\mathbf{32}_K$ to $\mathbf{32}_{f+1}$.

In the above embodiment, the first data latch part 132 cannot start capturing of the pixel data corresponding to the next one horizontal scan line unless the respective second data latch parts 133 of the driver ICs 3*a* to 3*e* finish supplying all the pixel data to the gradation voltage conversion circuit 135. Accordingly, in the case of applying the pixel drive voltages G to the data lines D of the display device 20 in each horizontal scanning period in accordance with the delay configuration as illustrated in FIG. 11 for example, it is necessary to prevent maximum delay time $T_{MAX}$, which starts at the time of supplying the load signal LD, from elongating into the next horizontal scanning period. This requires limitation of the maximum delay time $T_{MAX}$ or expansion of the horizontal scanning period.

A buffer data latch may be provided between the first data latch part 132 and the second data latch part 133 so that capturing of the pixel data corresponding to the next one horizontal scan line can be started before the second data latch part 133 finishes supplying all the pixel data to the gradation voltage conversion circuit 135.

Figure 16:
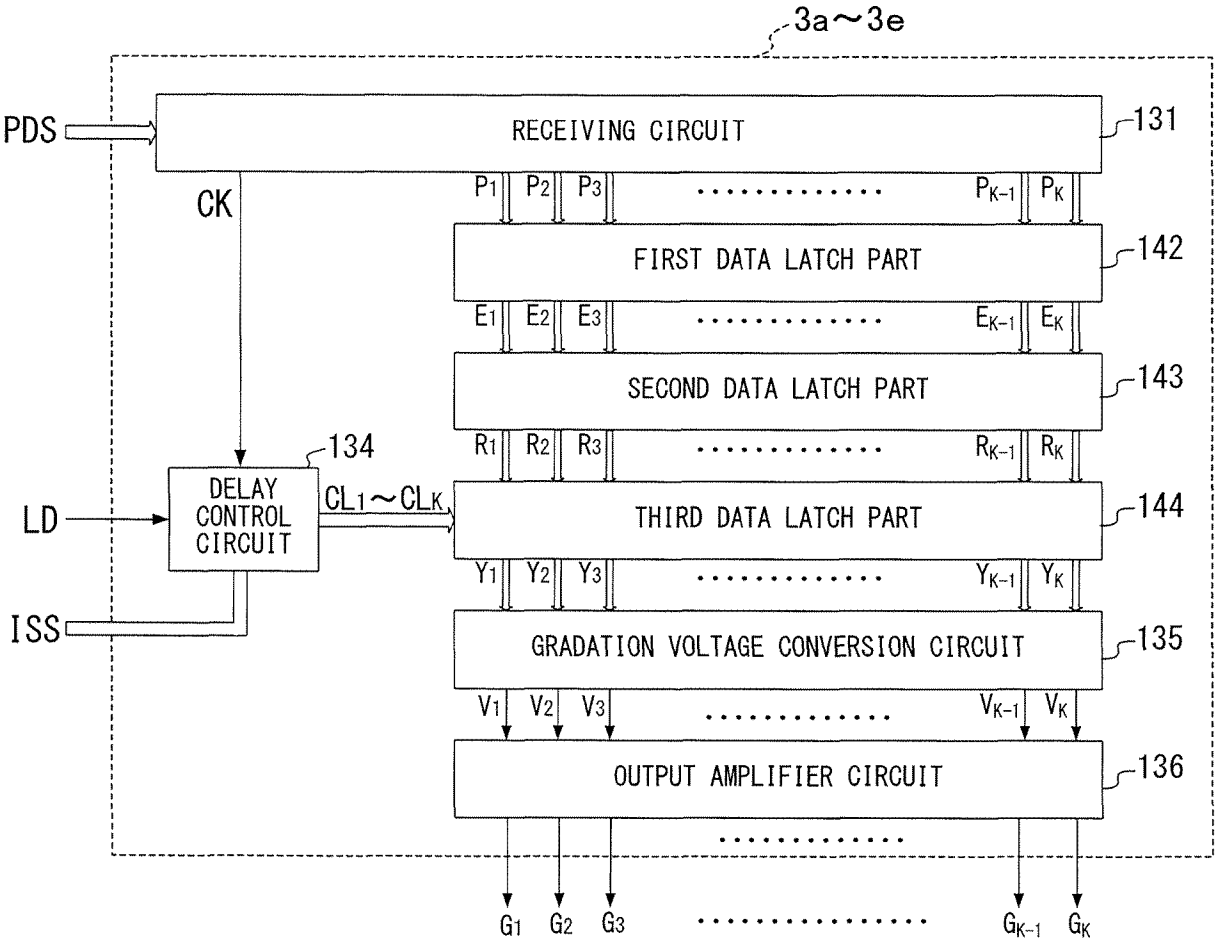
FIG. 16 is a block diagram illustrating another example of the internal configuration of each of the driver ICs 3*a* to 3*e*.

FIG. 16 is a block diagram illustrating another internal configuration of the respective driver ICs 3*a* to 3*e* made in view of this point. In the driver IC illustrated in FIG. 16, a first data latch part 142 and a second data latch part 143 are provided in place of the first data latch part 132 and the second data latch part 133 illustrated in FIG. 2. Furthermore, a third data latch part 144 is newly provided between the second data latch part 143 and the gradation voltage conversion circuit 135. Other configuration aspects are identical to those illustrated in FIG. 2.

In FIG. 16, the first data latch part 142 captures each of the pixel data $P_1$ to $P_K$ supplied from the receiving circuit 131 in order of being supplied, and supplies the captured data as pixel data $E_1$ to $E_K$ to the subsequent second data latch part 143. The second data latch part 143 captures the pixel data $E_1$ to $E_K$ at the same time, and supplies captured data as pixel data $R_1$ to $R_K$ to the subsequent third data latch part 144. The third data latch part 144 has the same internal configuration as the second data latch part 133 illustrated in FIG. 3. Like the second data latch part 133, the third data latch part 144 captures the above-stated pixel data $R_1$ to $R_K$ delayed in accordance with the delay configuration illustrated in FIG. 5, 7 or 9, in response to the delay capture clock signals $CL_1$ to $CL_K$ supplied from the delay control circuit 134, and supplies the captured data to the gradation voltage conversion circuit 135 as pixel data $Y_1$ to $Y_K$.

Therefore, according to the configuration illustrated in FIG. 16, the second data latch part 143 functions as a buffer memory, so that the first data latch part 142 can start capturing of the pixel data corresponding to the next one horizontal scan line even when the third data latch part 144 is still in the middle of sending out the pixel data $Y_1$ to $Y_K$. This makes it unnecessary to limit the maximum delay time $T_{MAX}$ and expand the horizontal scanning period at the time of delaying and applying the pixel drive voltages G.

The above-disclosed embodiment employs a so-called clock data recovery scheme in which a pixel data signal PDS having a reference timing signal RS superimposed thereon is supplied to the driver ICs 3*a* to 3*e* and a reference clock signal CK is reproduced in the respective driver ICs 3 on the basis of this reference timing signal RS. According to this scheme, the clock signal is supplied to each of the driver ICs 3*a* to 3*e* from the outside. However, the drive controller 1 may supply the reference clock signal CK directly to the respective driver ICs 3*a* to 3*e* without adopting such a clock data recovery scheme.

Figure 17:
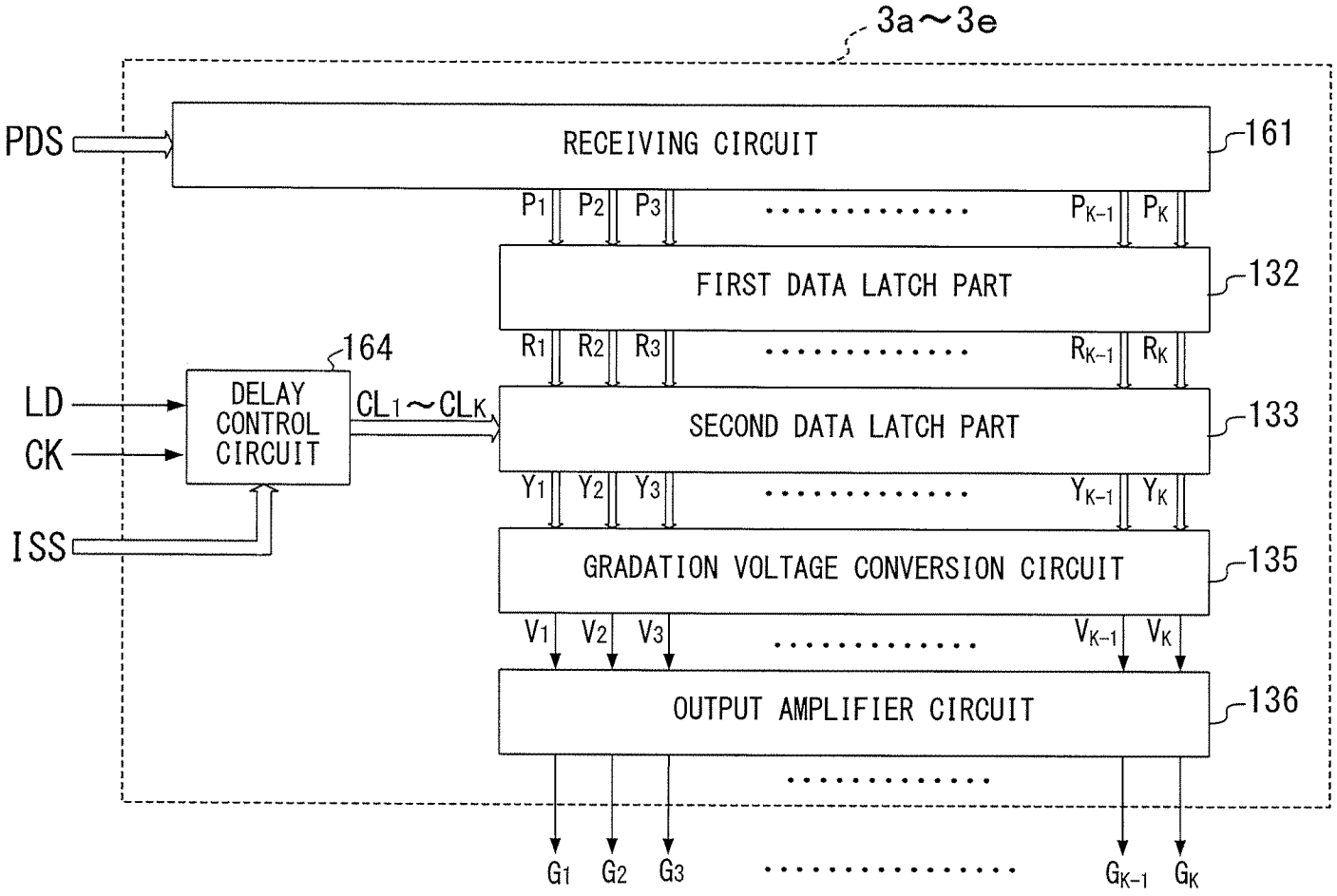
FIG. 17 is a block diagram illustrating another example of the internal configuration of each of the driver ICs 3*a* to 3*e*.

FIG. 17 is a block diagram illustrating the internal configuration of the respective driver ICs 3*a* to 3*e* made in view of this point. In the configuration illustrated in FIG. 17, a receiving circuit 161 is adopted in place of the receiving circuit 131, and a delay control circuit 164 is adopted in place of the delay control circuit 134. Other configuration aspects are identical to those illustrated in FIG. 2.

In FIG. 17, like the receiving circuit 131, the receiving circuit 161 captures a sequence of pixel data PD from a pixel data signal PDS supplied from the drive controller 1, and supplies the pixel data PD for one horizontal scan line (n pieces) to the first data latch part 132 as pixel data $P_1$ to $P_K$. Unlike the receiving circuit 131, the receiving circuit 161 does not reproduce the reference clock signal CK. In this case, the drive controller 1 supplies the above-stated reference clock signal CK directly to the delay control circuits 164 of the respective driver ICs 3*a* to 3*e*. Like the delay control circuit 134, the delay control circuit 164 performs initial setting in accordance with the initial setting signal ISS, and then generates the delay capture clock signals $CL_1$ to $CL_K$ synchronized with the reference clock signal CK, in response to the load signal LD. The delay control circuit 164 then supplies the delay capture clock signals $CL_1$ to $CL_K$ to the second data latch part 133. More specifically, the shift registers formed in the delay control circuits of the respective driver ICs 3*a* to 3*e* capture a single pulse load signal while sequentially shifting the single pulse load signal to the subsequent stages, in synchronization with the reference clock signal CK serving as a reference timing signal supplied from the outside. As a result, the delay capture clock signals $CL_1$ to $CL_K$ are generated.

This application is based on Japanese Patent Application No. 2014-17236 which is herein incorporated by reference.

What is claimed is:

1. A display driver for applying pixel drive voltages to respective N data lines of a display device, N being a natural number of 2 or more, said pixel drive voltages corresponding to luminance levels of respective pixels represented by a video signal, said display driver comprising:

first to N-th latches configured to capture and output N pieces of pixel data indicative of the luminance levels of the respective pixels in synchronization with first to N-th capture clock signals each having different edge timing; and an N stage shift register configured to capture a load signal synchronized with a horizontal synchronizing signal in the video signal while sequentially shifting said load signal to a subsequent stage in synchronization with a reference timing signal supplied from an outside, said N stage shift register including first to N-th flip-flops connected in series to supply outputs of said first to N-th flip-flops to said first to N-th latches as said first to N-th capture clock signals, respectively, a delay setting part configured to receive an initial setting signal supplied from the outside, said initial setting signal representing load delay time information for specifying, as a load delay time, a period of time from a supply point of said load signal to an actual start point of loading said pixel data, and delay mode information for specifying a delay mode, and to supply said load signal to at least one of said first and said N-th flip-flops when said load delay time specified by said load delay time information of the received initial setting signal is passed after said load signal is supplied to said delay setting part from the outside, and a shift direction switching part having a plurality of shift direction switches connected to inputs of said first to N-th flip-flops, respectively, the shift direction switching part being configured to switch a shift direction of said load signal in said first to N-th flip-flops through said shift direction switches in accordance with said delay mode specified by said delay mode information of said initial setting signal.

2. The display driver according to claim 1, wherein said shift direction corresponds to one of:

a first shift mode for shifting said load signal to a flip-flop in a subsequent stage in order of said first to N-th flip-flops;

a second shift mode for shifting said load signal to a flip-flop in a subsequent stage in order of said n-th to first flip-flops; and a third shift mode for shifting said load signal to a flip-flop in a subsequent stage in order of said first to f-th flip-flops, while shifting said load signal to a flip-flop in a subsequent stage in order of said N-th to (f+1)-th flip-flops, f being a natural number less than N.

3. The display driver according to claim 1, wherein said load signal is constituted by a single pulse appearing within each of horizontal synchronization period.

4. The display driver according to claim 1, wherein said N stage shift register further includes:

a first shift register that captures said load signal while sequentially shifting said load signal to a subsequent stage in synchronization with a first timing signal having a frequency that is half the frequency of said reference timing signal; and a second shift register that captures said load signal while sequentially shifting said load signal to a subsequent stage in synchronization with a second timing signal having a frequency identical to the frequency of said first timing signal and having a phase different from a phase of said first timing signal, wherein said first shift register supplies outputs of the respective flip-flops connected in series as odd-numbered capture clock signals among said first to N-th capture clock signals, to odd-numbered latches among said first to N-th latches, respectively, and said second shift register supplies outputs of the respective flip-flops connected in series as even-numbered capture clock signals among said first to N-th capture clock signals, to even-numbered latches among said first to N-th latches, respectively.

5. The display driver according to claim 1, further comprising:

a gradation voltage conversion circuit configured to convert the N pieces of pixel data output from said first to N-th latches into first to N-th pixel drive voltages having voltage values corresponding to their luminance levels; and an output circuit configured to supply said first to N-th pixel drive voltages to the N data lines of said display device.

6. A control method of a display driver for applying pixel drive voltages to respective N data lines of a display device, N being a natural number of 2 or more, said pixel drive voltages corresponding to luminance levels of respective pixels represented by a video signal, said display driver including first to N-th latches configured to capture and output N pieces of pixel data indicative of the luminance levels of the respective pixels in synchronization with first to N-th capture clock signals each having different edge timing, and an N stage shift register configured to capture a load signal synchronized with a horizontal synchronizing signal in the video signal while sequentially shifting said load signal to a subsequent stage in synchronization with a reference timing signal supplied from an outside, said N stage shift register including first to N-th flip-flops connected in series to supply outputs of said first to N-th flip-flops to said first to N-th latches as said first to N-th capture clock signals, respectively, a delay setting part, and a shift direction switching part having a plurality of shift direction switches connected to inputs of said first to N-th flip-flops, respectively, said method comprising:

a step of receiving, via the delay setting part, an initial setting signal supplied from the outside, said initial setting signal representing load delay time information for specifying, as a load delay time, a period of time from a supply point of said load signal to an actual start point of loading said pixel data, and delay mode information for specifying a delay mode, a step of supplying, via the delay setting part, said load signal to at least one of said first and said N-th flip-flops when said load delay time specified by said load delay time information of the received initial setting signal is passed after said load signal is supplied to said delay setting part from the outside, and a step of switching, in the shift direction switching part, a shift direction of said load signal in said first to N-th flip-flops through said shift direction switches in accordance with said delay mode specified by said delay mode information of said initial setting signal.

7. A display apparatus, comprising:

a display device having a plurality of horizontal scan lines each formed to extend in a horizontal direction on a two-dimensional screen, N data lines each formed to extend in a vertical direction on said screen, N being a natural number of 2 or more, and display cells formed in crossing parts between said horizontal scan lines and said data lines;

a scanning driver configured to generate a horizontal scanning pulse in synchronization with a horizontal synchronizing signal of a video signal and to apply said horizontal scanning pulse to each of said horizontal scan lines in sequence; and a data driver configured to apply pixel drive voltages to the respective N data lines, said pixel drive voltages corresponding to luminance levels of the respective display cells represented by said video signal, said data driver including first to N-th latches configured to capture and output N pieces of pixel data indicative of the luminance levels of the respective display cells in synchronization with first to N-th capture clock signals each having different edge timing, and an N stage shift register configured to capture a load signal synchronized with a horizontal synchronizing signal in the video signal while sequentially shifting said load signal to a subsequent stage in synchronization with a reference timing signal supplied from an outside, said N stage shift register including first to N-th flip-flops connected in series to supply outputs of said first to N-th flip-flops to said first to N-th latches as said first to N-th capture clock signals, respectively, a delay setting part configured to receive an initial setting signal supplied from the outside, said initial setting signal representing load delay time information for specifying, as a load delay time, a period of time from a supply point of said load signal to an actual start point of loading said pixel data, and delay mode information for specifying a delay mode, and to supply said load signal to at least one of said first and said N-th flip-flops when said load delay time specified by said load delay time information of the received initial setting signal is passed after said load signal is supplied to said delay setting part from the outside, and a shift direction switching part having a plurality of shift direction switches connected to inputs of said first to N-th flip-flops, respectively, the shift direction switching part being configured to switch a shift direction of said load signal in said first to N-th flip-flops through said shift direction switches in accordance with said delay mode specified by said delay mode information of said initial setting signal.

8. The display apparatus according to claim 7, further comprising a drive controller configured to extract said horizontal synchronizing signal from said video signal, to supply said horizontal synchronizing signal to said scanning driver, to generate said load signal in synchronization with said horizontal synchronizing signal, to generate said N pieces of pixel data based on said video signal, to superimpose said reference timing signal indicative of the timing of a clock signal on said N pieces of pixel data to generate a pixel data signal which is supplied to said data driver, and to generate said initial setting signal to supply to said data driver.

9. The display apparatus according to claim 7, wherein said data driver is formed from a plurality of semiconductor integrated circuit chips each having a same circuitry.

10. The display apparatus according to claim 9, wherein said plurality of semiconductor integrated circuit chips are disposed along one side of said display device in said horizontal direction and are each supplied with said initial setting signal, a plurality of initial setting signals are supplied to said plurality of semiconductor integrated circuit chips, and said load delay time specified by said load delay time information of one of said plurality of initial setting signals supplied to one of said plurality of semiconductor integrated circuit chips is different from that specified by said load delay time information of another of said plurality of said initial setting signals supplied to another of said plurality of semiconductor integrated circuit chips adjacent to said one.

11. The display apparatus according to claim 7, wherein said shift direction corresponds to one of:

a first shift mode for shifting said load signal to a flip-flop in a subsequent stage in order of said first to N-th flip-flops;

a second shift mode for shifting said load signal to a flip-flop in a subsequent stage in order of said n-th to first flip-flops; and a third shift mode for shifting said load signal to a flip-flop in a subsequent stage in order of said first to f-th flip-flops, while shifting said load signal to a flip-flop in a subsequent stage in order of said N-th to (f+1)-th flip-flops, f being a natural number less than N.

12. The display apparatus according to claim 7, further comprising a gradation voltage conversion circuit configured to convert the N pieces of pixel data output from said first to N-th latches into first to N-th pixel drive voltages having voltage values corresponding to their luminance levels; and an output circuit configured to supply said first to N-th pixel drive voltages to the N data lines of said display device.

13. A display apparatus comprising:

a display device having a plurality of horizontal scan lines each formed to extend in a horizontal direction on a two-dimensional screen, N data lines each formed to extend in a vertical direction on said screen, N being a natural number of 2 or more, and display cells formed in crossing parts between said horizontal scan lines and said data lines;

a scanning driver configured to generate a horizontal scanning pulse in synchronization with a horizontal synchronizing signal of a video signal and to apply said horizontal scanning pulse to each of said horizontal scan lines in sequence; and a data driver configured to apply pixel drive voltages to the respective N data lines, said pixel drive voltages corresponding to luminance levels of the respective display cells represented by said video signal, said data driver including first to N-th latches configured to capture and output N pieces of pixel data indicative of the luminance levels of the respective display cells in synchronization with first to N-th capture clock signals each having different edge timing; and an N stage shift register configured to capture a load signal synchronized with a horizontal synchronizing signal in the video signal while sequentially shifting said load signal to a subsequent stage in synchronization with a reference timing signal supplied from an outside, said N stage shift register including first to N-th flip-flops connected in series to supply outputs of said first to N-th flip-flops to said first to N-th latches as said first to N-th capture clock signals, respectively, a delay setting part configured to receive an initial setting signal supplied from the outside, said initial setting signal representing load delay time information for specifying, as a load delay time, a period of time from a supply point of said load signal to an actual start point of loading said pixel data, and delay mode information for specifying a delay mode, and to supply said load signal to at least one of said first and said N-th flip-flops when said load delay time specified by said load delay time information of the received initial setting signal is passed after said load signal is supplied to said delay setting part from the outside, and a shift direction switching part configured to switch a shift direction of said load signal in said first to N-th flip-flops in accordance with said delay mode specified by said delay mode information of said initial setting signal, wherein said data driver is formed from a plurality of semiconductor integrated circuit chips each having a same circuitry, said plurality of semiconductor integrated circuit chips are disposed along one side of said display device in said horizontal direction and are each supplied with said initial setting signal, a plurality of initial setting signals are supplied to said plurality of semiconductor integrated circuit chips, and said load delay time specified by said load delay time information of one of said plurality of initial setting signals supplied to one of said plurality of semiconductor integrated circuit chips is different from that specified by said load delay time information of another of said plurality of said initial setting signals supplied to another of said plurality of semiconductor integrated circuit chips adjacent to said one.

* * * * *